US010863817B2

(12) United States Patent
Yeates et al.

(10) Patent No.: US 10,863,817 B2
(45) Date of Patent: Dec. 15, 2020

(54) MODULAR ATTACHMENT MATRIX ARRAY

(71) Applicant: Sentry Solutions Products Group LLC, Virginia Beach, VA (US)

(72) Inventors: Eric M. Yeates, Virginia Beach, VA (US); Nicholas A. Ferros, Virginia Beach, VA (US); Frederick W. Storms, Jr., Virginia Beach, VA (US)

(73) Assignee: Sentry Solutions Products Group LLC, Virginia Beach ( * ) Notice: Subject to any disclaimer, the term of this patent is extended or adjusted under 35 U.S.C. 154(b) by 0 days.

(21) Appl. No.: 16/127,005

(22) Filed: Sep. 10, 2018

(65) Prior Publication Data

US 2019/0000221 A1 Jan. 3, 2019

Related U.S. Application Data

(63) Continuation-in-part of application No. PCT/US2017/067361, filed on Dec. 19, 2017.
(Continued)

(51) Int. Cl.

| | |
|---|---|
| ***A45F 5/00*** | (2006.01) |
| ***A45C 3/00*** | (2006.01) |
| ***F41C 33/04*** | (2006.01) |
| ***A45F 5/02*** | (2006.01) |
| ***A41D 1/04*** | (2006.01) |

(Continued)

(52) U.S. Cl.
CPC ..... *A45F 5/00* (2013.01); *A41D 1/04* (2013.01); *A41D 15/00* (2013.01); *A41D 27/20* (2013.01); *A45C 3/001* (2013.01); *A45F 3/04* (2013.01); *A45F 5/02* (2013.01); *F41C 33/046* (2013.01); *A41D 2400/48* (2013.01); *A45C 2013/306* (2013.01); *A45F 2003/001* (2013.01)

(58) Field of Classification Search
CPC ..... A45F 5/00; A45F 3/04; A45F 5/02; A45F 2003/001; A41D 1/04; A41D 15/00; A41D 27/20; A41D 2400/48; A45C 3/001; A45C 2013/306; F41C 33/046
See application file for complete search history.

(56) References Cited

U.S. PATENT DOCUMENTS

| | | | |
|---|---|---|---|
| 4,934,573 | A | 6/1990 | Jaeger |
| D677,433 | S | 3/2013 | Swan et al. |

(Continued)

FOREIGN PATENT DOCUMENTS

| | | |
|---|---|---|
| EP | 1260151 | 7/2004 |
| GB | 2491624 | 12/2012 |
| WO | WO2016201363 | 12/2016 |

OTHER PUBLICATIONS 5.11 Tactical Introduces HEXGRID Molle Compatible Attachment System; https://www.thefirearmblog.com/blog/2016/01/28/5-11-tactical-introduces-hexgrid-molle-compatible-attachment-system/; Jan. 28, 2016.

*Primary Examiner* — Corey N Skurdal
(74) *Attorney, Agent, or Firm* — Shaddock Law Group, PC

(57) ABSTRACT

A modular attachment matrix array having a matrix array layer, wherein the matrix array layer comprises a plurality of spaced apart matrix array apertures, wherein each of the matrix array apertures is formed through the matrix array layer and is formed as an elongated octagon, and wherein the matrix array apertures are arranged in a repeating sequence of equally spaced rows and equally spaced columns. In certain exemplary embodiments, the matrix array layer is at least partially attached or coupled to at least a portion of a carrier material.

20 Claims, 20 Drawing Sheets

Related U.S. Application Data

(60) Provisional application No. 62/476,771, filed on Mar. 25, 2017, provisional application No. 62/450,481, filed on Jan. 25, 2017, provisional application No. 62/445,934, filed on Jan. 13, 2017, provisional application No. 62/436,399, filed on Dec. 19, 2016.

(51) Int. Cl.

| | |
|---|---|
| ***A41D 15/00*** | (2006.01) |
| ***A41D 27/20*** | (2006.01) |
| ***A45F 3/04*** | (2006.01) |
| *A45C 13/30* | (2006.01) |
| *A45F 3/00* | (2006.01) |

(56) References Cited

U.S. PATENT DOCUMENTS

| | | | |
|---|---|---|---|
| 9,144,255 | B1 | 9/2015 | Perciballi |
| 9,173,436 | B2 | 11/2015 | Crye |
| 2012/0180184 | A1 | 7/2012 | Crye |
| 2015/0189977 | A1 | 7/2015 | Thompson |
| 2016/0040958 | A1 | 2/2016 | Alcantra et al. |
| 2017/0320286 | A1 | 11/2017 | Carlson |

MODULAR ATTACHMENT MATRIX ARRAY

CROSS-REFERENCE TO RELATED APPLICATIONS

This patent application is a continuation-in-part, of International Patent Application No. PCT/US2017/067361, filed Dec. 19, 2017, which claims the benefit of U.S. Patent Application Ser. No. 62/476,771, filed Mar. 25, 2017, U.S. Patent Application Ser. No. 62/450,481, filed Jan. 25, 2017, U.S. Patent Application Ser. No. 62/445,934, filed Jan. 13, 2017, and U.S. Patent Application Ser. No. 62/436,399, filed Dec. 19, 2016, the disclosures of which are incorporated herein in their entireties by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE PRESENT DISCLOSURE

1. Field of the Present Disclosure

The present disclosure relates generally to the field of modular attachment systems. More specifically, the presently disclosed systems, methods, and/or apparatuses relates to a modular attachment system having a matrix array.

2. Description of Related Art

It is advantageous be able to configure and/or reconfigure various pouches, pockets, holsters, holders, and other accessories on items such as, for example, articles of clothing, vests, plate carriers, backpacks, packs, platforms, and other carriers.

It is generally known to removably attach such items using a MOLLE or other similar attachment system. The term MOLLE (Modular Lightweight Load-carrying Equipment) is used to generically describe load bearing systems and subsystems that utilize corresponding rows of woven webbing for modular pouch, pocket, and accessory attachment.

The MOLLE system is a modular system that incorporates the use of corresponding rows of webbing stitched onto a piece of equipment, such as a vest, and the various MOLLE compatible pouches, pockets, and accessories, each accessory having mating rows of stitched webbing. MOLLE compatible pouches, pockets, and accessories of various utility can then be attached or coupled wherever MOLLE webbing exists on the equipment.

The terms "MOLLE-compatible" or "MOLLE" system are not used to describe a specific system, but to generically describe accessory attachment systems that utilize interwoven PALS (Pouch Attachment Ladder System) webbing for modular accessory attachment.

As illustrated in FIGS. 1-2, an exemplary MOLLE compatible carrier portion 10 includes a plurality of substantially parallel rows of spaced apart, horizontal carrier webbing elements 23. Each of the carrier webbing elements 23 is secured to a backing or carrier material 12, by vertical stitching 24, at spaced apart locations, such that a tunnel segment 27 is formed between the carrier material 12 and the carrier webbing elements 23 between each secured location of the carrier webbing elements 23. Each of the tunnel segments 27 is formed substantially perpendicular to a longitudinal axis or direction of the carrier webbing elements 23.

The MOLLE compatible carrier portion 10, or MOLLE system grid, typically consists of horizontal rows of 1 inch (2.5 cm) webbing, spaced 1 inch apart, and attached or coupled to the carrier material 12 at 1.5 inch (3.8 cm) intervals.

An exemplary accessory 81 includes a plurality of substantially parallel, spaced apart accessory webbing elements 83. The accessory webbing elements 83 are spaced apart so as to correspond to the spaces between the spaced apart carrier webbing elements 23. The accessory webbing elements 83 are secured to the accessory 81 at spaced apart locations, such that an accessory tunnel segment 87 is formed between the accessory 81 and the accessory webbing element 83 between each secured location of the accessory webbing element 83. Each of the accessory tunnel segments 87 is formed substantially perpendicular to a longitudinal direction of the accessory webbing elements 83.

When the accessory 81 is placed adjacent the carrier material 12 such that the accessory webbing elements 83 are within the spaces between the spaced apart carrier webbing elements 23 (and the carrier webbing elements 23 are within the spaces between the spaced apart accessory webbing elements 83) and corresponding tunnel segments 27 and accessory tunnel segments 87 are aligned, a strap or coupling element may be interwoven between the aligned tunnel segments 27 and accessory tunnel segments 87 (alternating between horizontal carrier webbing element 23 portions on the host or carrier material 12 and horizontal webbing portions on the accessory 81) to removably attach the accessory 81 to the carrier material 12.

Thus, through the use of a MOLLE or MOLLE-type system, an accessory 81 may be mounted to a variety of carrier materials 12. Likewise, if a particular carrier material 12 includes a MOLLE compatible system, a variety of accessories may be interchangeably mounted to the platform to accommodate a variety of desired configurations.

MOLLE compatible systems allow, for example, various pouch arrangements to be specifically tailored to a desired configuration and then reconfigured, if desired. Various desired pouches, pockets, and accessories can be added and undesired or unnecessary pouches, pockets, or accessories can be removed.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE PRESENT DISCLOSURE

However, the typical "MOLLE-compatible" or "MOLLE" system arrangement has various shortcomings. For example, known "MOLLE-compatible" or "MOLLE" systems only allow for attachment of accessories in a single orientation relative to the carrier webbing elements. In most applications, this results in only vertical attachment of accessories to the MOLLE system, i.e., attachment perpendicular to the longitudinal axis, $A_L$, of the carrier webbing elements.

In various exemplary, non-limiting embodiments, the modular attachment matrix array of the presently disclosed systems, methods, and/or apparatuses provides a matrix array layer that allows MOLLE-compatible or similar accessories to be attached or coupled to the matrix array layer in a vertical, horizontal, oblique, or diagonal manner, relative to a row or column of spaced apart matrix array apertures.

In various exemplary, nonlimiting embodiments, the modular attachment matrix array of the present disclosure comprises at least some of a portion of carrier material; and a matrix array layer, wherein the matrix array layer comprises a plurality of spaced apart matrix array apertures, wherein each of the matrix array apertures is formed through the matrix array layer and is formed as an elongated octagon, and wherein the matrix array apertures are arranged in a repeating sequence of equally spaced rows and equally spaced columns, and wherein the matrix array layer is at least partially attached or coupled to at least a portion of the carrier material.

In various exemplary, nonlimiting embodiments, the plurality of spaced apart matrix array apertures are arranged in a repeating sequence of equally spaced rows of the substantially octagonally shaped matrix array apertures and equally spaced columns of the substantially octagonally shaped matrix array apertures.

In various exemplary, nonlimiting embodiments, matrix array tunnel segments are created between adjacent matrix array apertures.

In various exemplary, nonlimiting embodiments, matrix array tunnel segments are created between vertically adjacent matrix array apertures, between horizontally adjacent matrix array apertures, between obliquely adjacent matrix array apertures, and/or between diagonally adjacent matrix array apertures.

In various exemplary, nonlimiting embodiments, each of the matrix array apertures is defined by one or more continuous edges.

In various exemplary, nonlimiting embodiments, each adjacent column of spaced apart matrix array apertures is offset such that at least edges or proximate centers of adjacent matrix array apertures are offset by approximately ±33°.

In various exemplary, nonlimiting embodiments, each column of spaced apart matrix array apertures at least partially overlaps an adjacent column of spaced apart matrix array apertures.

In various exemplary, nonlimiting embodiments, each matrix array aperture is separated from each other matrix array aperture by a distance that is less than a width of each matrix array aperture.

In various exemplary, nonlimiting embodiments, the matrix array layer comprises chlorosulfonated polyethylene (CSPE) synthetic rubber (CSM).

In various exemplary, nonlimiting embodiments, the matrix array layer comprises a portion of Hypalon fabric.

In various exemplary, nonlimiting embodiments, the modular attachment matrix array of the present disclosure comprises at least some of a matrix array layer, wherein the matrix array layer comprises a plurality of spaced apart matrix array apertures, wherein each of the matrix array apertures is formed through the matrix array layer and is formed as an elongated octagon, and wherein the matrix array apertures are arranged in a repeating or semi-repeating series or sequence of equally spaced rows and equally spaced columns.

In various exemplary, nonlimiting embodiments, the modular attachment matrix array of the present disclosure comprises at least some of a matrix array layer, wherein the matrix array layer comprises a plurality of spaced apart matrix array apertures, wherein the matrix array apertures are formed as substantially elongated octagonally shaped matrix array apertures arranged in a repeating sequence of equally spaced rows of the substantially octagonally shaped matrix array apertures and equally spaced columns of the substantially octagonally shaped matrix array apertures.

Accordingly, the presently disclosed systems, methods, and/or apparatuses separately and optionally provide a modular attachment matrix array that allows a user to readily attach MOLLE-compatible or similar accessories to the matrix array layer in a vertical, horizontal, oblique, or diagonal manner.

The presently disclosed systems, methods, and/or apparatuses separately and optionally provide a modular attachment matrix array that allows a user to attach an accessory to the matrix array layer by interweaving an accessory coupling element between aligned matrix array tunnel segments and accessory tunnel segments to removably attach the accessory to the matrix array layer.

These and other aspects, features, and advantages of the presently disclosed systems, methods, and/or apparatuses are described in or are apparent from the following detailed description of the exemplary, non-limiting embodiments of the presently disclosed systems, methods, and/or apparatuses and the accompanying figures. Other aspects and features of embodiments of the presently disclosed systems, methods, and/or apparatuses will become apparent to those of ordinary skill in the art upon reviewing the following description of specific, exemplary embodiments of the presently disclosed systems, methods, and/or apparatuses in concert with the figures.

While features of the presently disclosed systems, methods, and/or apparatuses may be discussed relative to certain embodiments and figures, all embodiments of the presently disclosed systems, methods, and/or apparatuses can include one or more of the features discussed herein. Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the presently disclosed systems, methods, and/or apparatuses.

Any benefits, advantages, or solutions to problems that are described herein with regard to specific embodiments are not intended to be construed as a critical, required, or essential feature(s) or element(s) of the presently disclosed systems, methods, and/or apparatuses or the claims.

BRIEF DESCRIPTION OF THE SEVERAL VIEWS OF THE DRAWINGS

As required, detailed exemplary embodiments of the presently disclosed systems, methods, and/or apparatuses are disclosed herein; however, it is to be understood that the disclosed embodiments are merely exemplary of the presently disclosed systems, methods, and/or apparatuses that may be embodied in various and alternative forms, within the scope of the presently disclosed systems, methods, and/or apparatuses. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the presently disclosed systems, methods, and/or apparatuses.

The exemplary embodiments of the presently disclosed systems, methods, and/or apparatuses will be described in detail, with reference to the following figures, wherein like reference numerals refer to like parts throughout the several views, and wherein.

DETAILED DESCRIPTION OF EXEMPLARY EMBODIMENTS OF THE PRESENT DISCLOSURE

Figure 1:
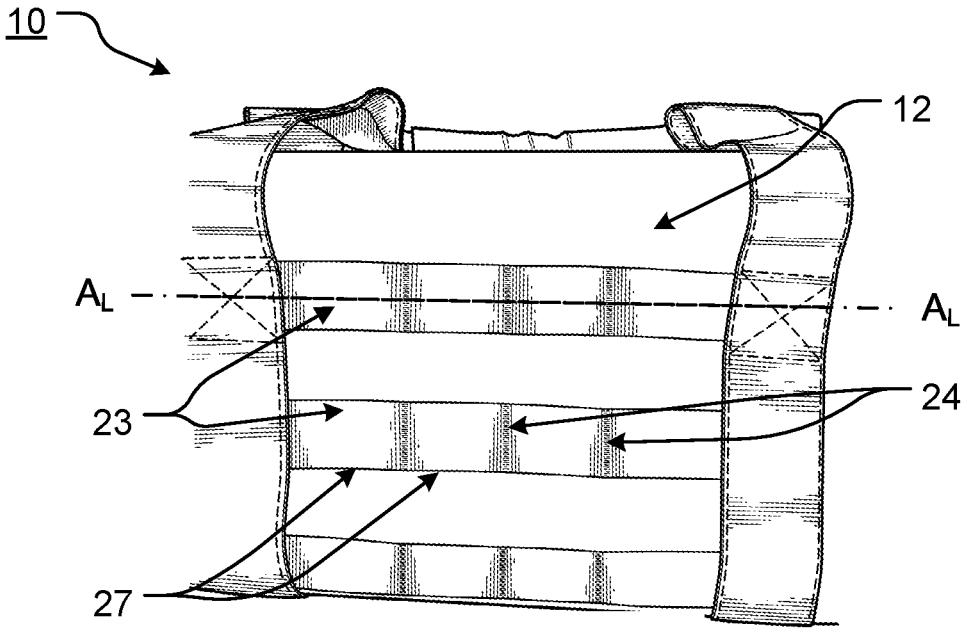
FIG. 1 PRIOR ART
FIG. 1 illustrates a portion of a known MOLLE compatible carrier portion attached or coupled to a carrier material.

For simplicity and clarification, the design factors and operating principles of the modular attachment matrix array according to the presently disclosed systems, methods, and/or apparatuses are explained with reference to various exemplary embodiments of a modular attachment matrix array according to the presently disclosed systems, methods, and/or apparatuses. The basic explanation of the design factors and operating principles of the modular attachment matrix array is applicable for the understanding, design, and operation of the modular attachment matrix array of the presently disclosed systems, methods, and/or apparatuses. It should be appreciated that the modular attachment matrix array can be adapted to many applications where a modular attachment matrix array can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the exemplary embodiments and/or elements such terms describe. Thus, these terms are not necessarily intended to indicate temporal or other prioritization of such exemplary embodiments and/or elements.

As used herein, and unless the context dictates otherwise, the term "coupled" is intended to include both direct coupling (in which two elements that are coupled to each other contact each other) and indirect coupling (in which at least one additional element is located between the two elements). The term coupled, as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "modular attachment matrix array", "matrix array layer", "carrier material", and "accessory" are used for basic explanation and understanding of the operation of the systems, methods, and apparatuses of the presently disclosed systems, methods, and/or apparatuses. Therefore, the terms "modular attachment matrix array", "matrix array layer", "carrier material", and "accessory" are not to be construed as limiting the systems, methods, and apparatuses of the presently disclosed systems, methods, and/or apparatuses.

For simplicity and clarification, the modular attachment matrix array of the presently disclosed systems, methods, and/or apparatuses will be shown and/or described as being used in conjunction with a side portion or surface of an exemplary bag or pack being utilized as an exemplary carrier material. However, it should be appreciated that these are merely exemplary embodiments of the modular attachment matrix array and are not to be construed as limiting the presently disclosed systems, methods, and/or apparatuses. Thus, the modular attachment matrix array of the presently disclosed systems, methods, and/or apparatuses may be utilized in conjunction with any object or device.

Additionally, the modular attachment matrix array of the presently disclosed systems, methods, and/or apparatuses will be shown and described as being used in conjunction with a compatible accessory 81, having at least one accessory webbing element 83, and at least one accessory coupling element 88. It should be appreciated that the compatible accessory 81 is merely an exemplary accessory and that any MOLLE compatible or similar accessory may be utilized in conjunction with the modular attachment matrix array of the present disclosure.

Figure 2:
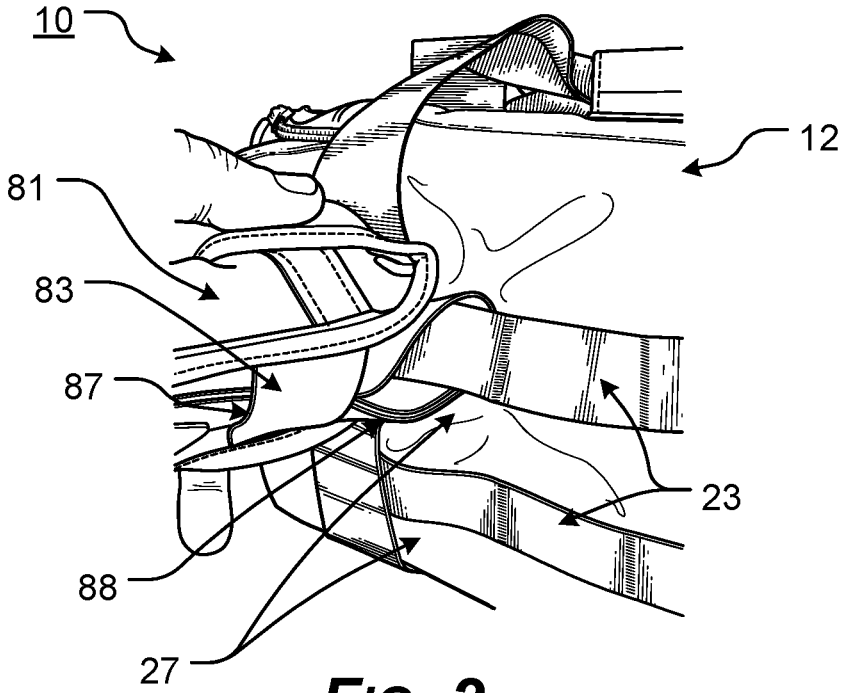
FIG. 2 PRIOR ART
FIG. 2 illustrates a MOLLE-compatible accessory being attached or coupled to a portion of a known MOLLE compatible carrier portion.
Figure 3:
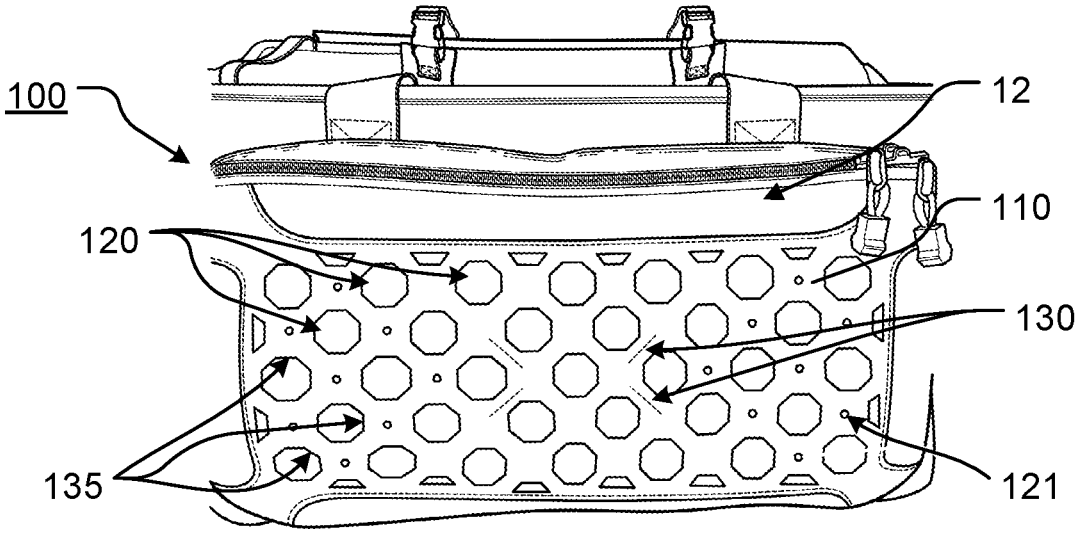
FIG. 3 illustrates an exemplary embodiment of the modular attachment matrix array attached or coupled to a carrier material, according to the presently disclosed systems, methods, and/or apparatuses.

Turning now to the appended drawing figures, FIGS. 1-2 illustrate certain elements and/or aspects of a portion of a known MOLLE compatible carrier portion 10 attached or coupled to a carrier material 12 and a MOLLE-compatible accessory 81 being attached or coupled to a portion of a known MOLLE compatible carrier portion 10, while FIGS. 3-31 illustrate certain elements and/or aspects of an exemplary embodiment of the modular attachment matrix array 100, according to the presently disclosed systems, methods, and/or apparatuses.

In certain illustrative, non-limiting embodiment(s) of the presently disclosed systems, methods, and/or apparatuses, as illustrated in FIGS. 3-31, the modular attachment matrix array 100 comprises at least some of a matrix array layer 110 having a plurality of spaced apart matrix array apertures 120 formed therethrough.

In certain exemplary embodiments, the matrix array layer 110 is formed of a portion of a fabric-type or other material, such as, for example, chlorosulfonated polyethylene (CSPE) synthetic rubber (CSM). In certain exemplary embodiments, the matrix array layer 110 is formed of a portion of Hypalon fabric. However, the present disclosure is not so limited. For example, in certain exemplary embodiments, the matrix array layer 110 may be formed of a rigid material, a semi-rigid material, or a substantially flexible material.

In various exemplary, non-limiting embodiments, all or portions of the matrix array layer 110 may be made of any fabric or other material, such as, for example, woven fabrics, canvas, acrylics, sheet fabrics, films, nylon, spandex, vinyl, Polyvinyl Chloride (PVC), neoprene, or the like. Alternatively, all or portions of the matrix array layer 110 may be formed from multiple, similar or dissimilar materials. In various exemplary, non-limiting embodiments, the matrix array layer 110 may be water-resistant or may include a cushion material.

As a further example, in certain exemplary embodiments, the matrix array layer 110 may be formed of a substantially rigid material, such as plastic, having an appropriate, workable thickness. Alternate materials of construction of the matrix array layer 110 may include one or more of the following: steel, stainless steel, aluminum, titanium, polytetrafluoroethylene, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the matrix array layer 110 is a design choice based on the desired appearance and functionality of the matrix array layer 110.

It should be appreciated that the terms fabric and material are to be given their broadest meanings and that the particular fabric(s) or material(s) used to form the matrix array layer 110 is a design choice based on the desired appearance and/or functionality of the modular attachment matrix array 100. In general, the material used to form the matrix array layer 110 is selected for its ability to allow a MOLLE-type accessory to be attached or coupled thereto.

The modular attachment matrix array 100 of the present disclosure is operable with as few as two matrix array apertures 120. Thus, the size and shape of the matrix array layer 110 is a design choice, based upon, for example, the size and shape of the carrier material 12 or portion of carrier material 12 that is desired to potentially accept attachment or coupling of accessories.

Figure 4:
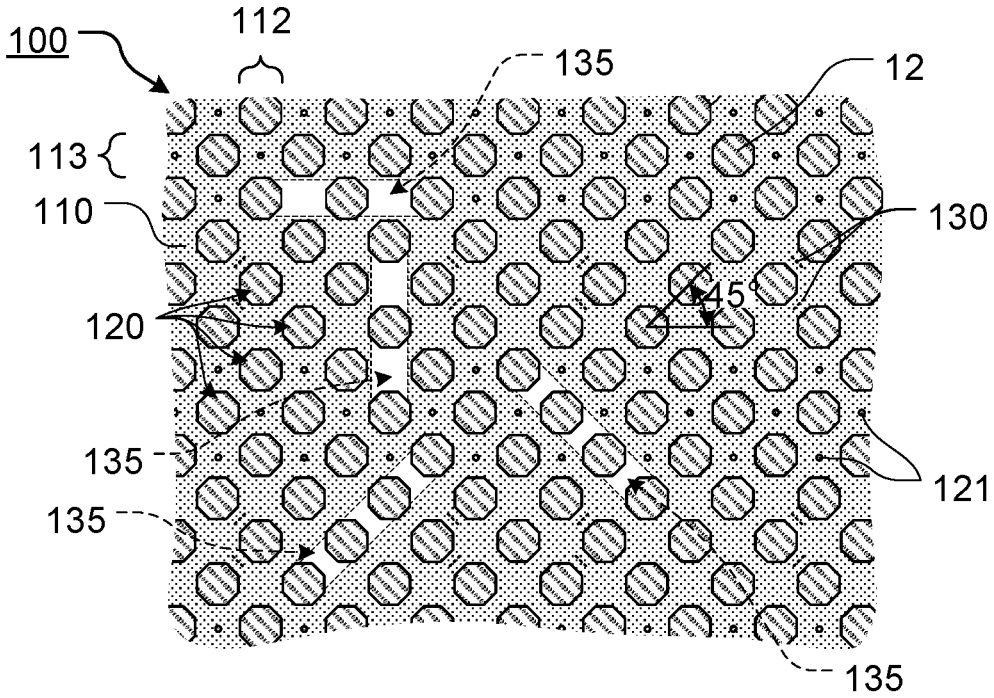
FIG. 4 illustrates a more detailed view of an exemplary embodiment of the modular attachment matrix array, wherein the modular attachment matrix array comprises substantially octagonally shaped matrix array apertures, arranged according to an exemplary embodiment of the presently disclosed systems, methods, and/or apparatuses.
Figure 5:
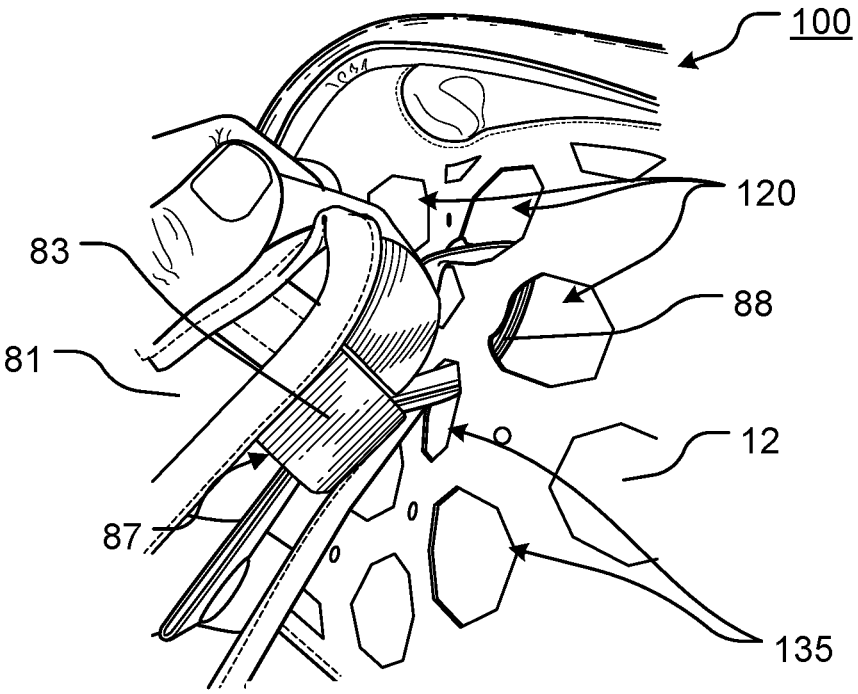
FIG. 5 illustrates a more detailed view of the interaction between the matrix array layer of the modular attachment matrix array and the accessory coupling element of an exemplary accessory, according to the presently disclosed systems, methods, and/or apparatuses.
Figure 6:
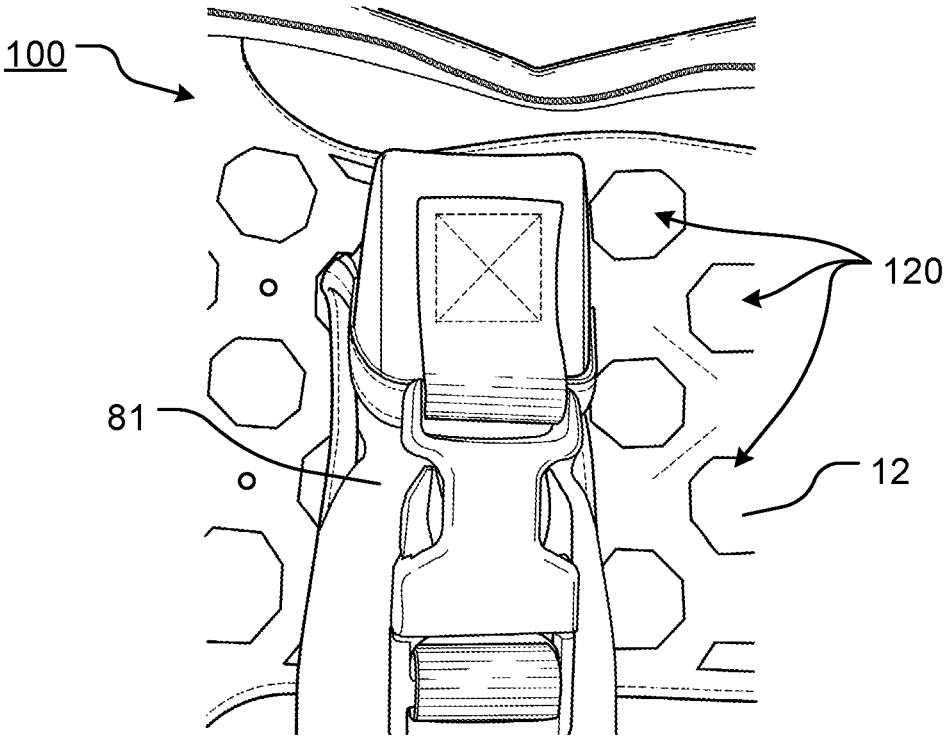
FIG. 6 illustrates an exemplary accessory attached or coupled to the matrix array layer of the modular attachment matrix array, according to the presently disclosed systems, methods, and/or apparatuses.
Figure 13:
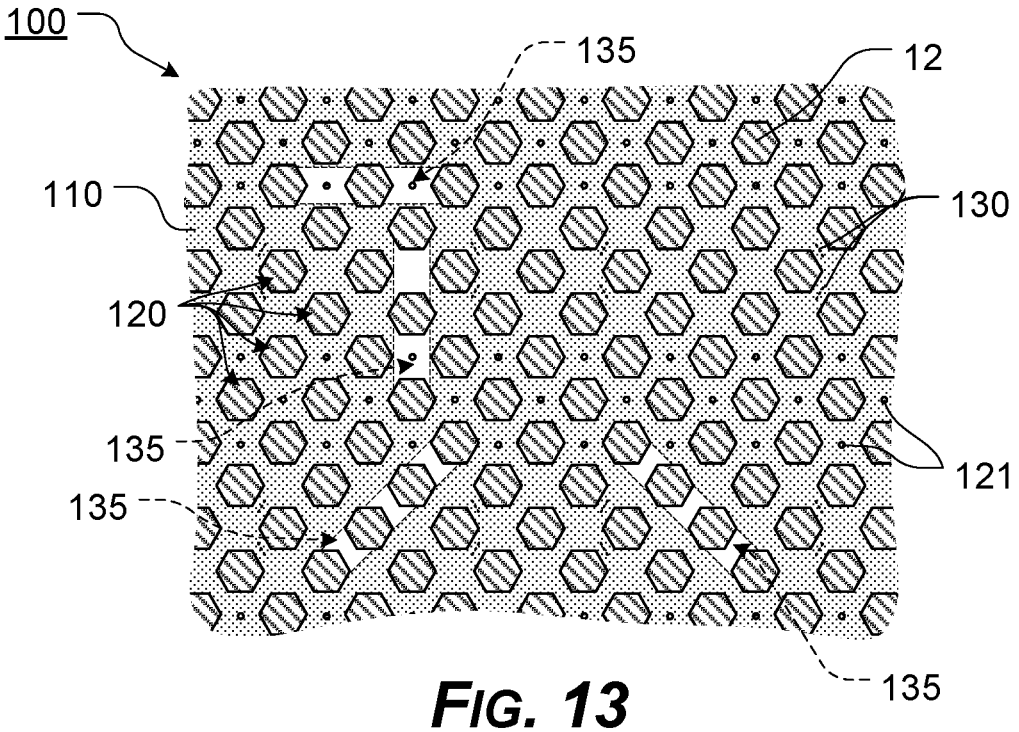
FIG. 13 illustrates an exemplary embodiment of the modular attachment matrix array attached or coupled to a carrier material, wherein the modular attachment matrix array comprises substantially hexagonally shaped matrix array apertures, arranged according to an exemplary embodiment of the presently disclosed systems, methods, and/or apparatuses.
Figure 14:
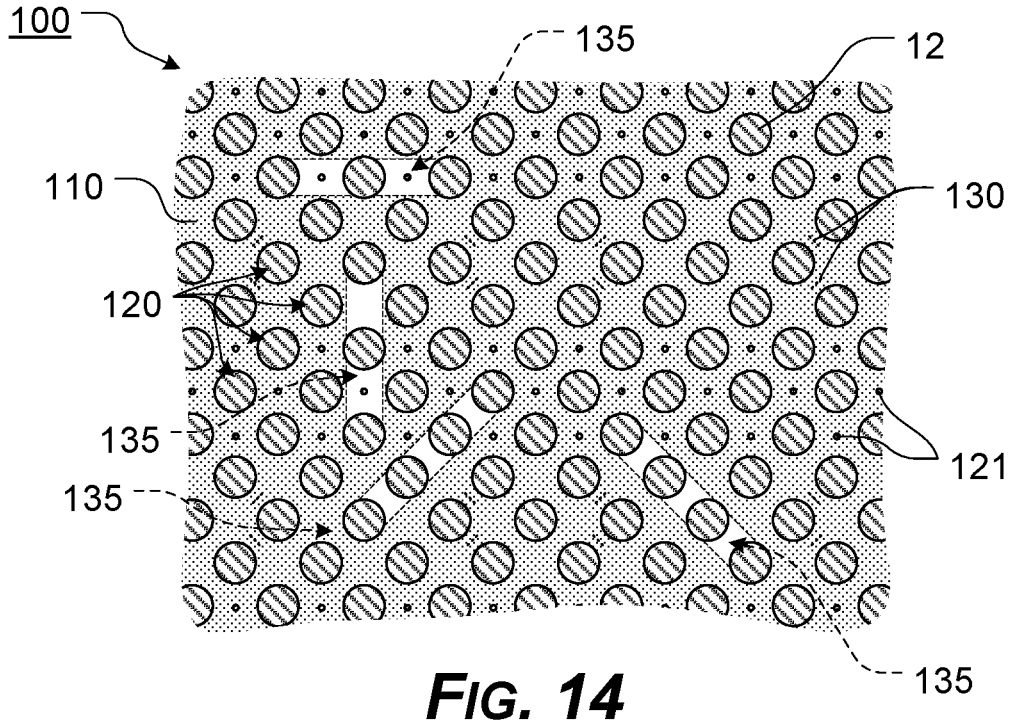
FIG. 14 illustrates an exemplary embodiment of the modular attachment matrix array attached or coupled to a carrier material, wherein the modular attachment matrix array comprises substantially circular shaped matrix array apertures, arranged according to an exemplary embodiment of the presently disclosed systems, methods, and/or apparatuses.
Figure 24:
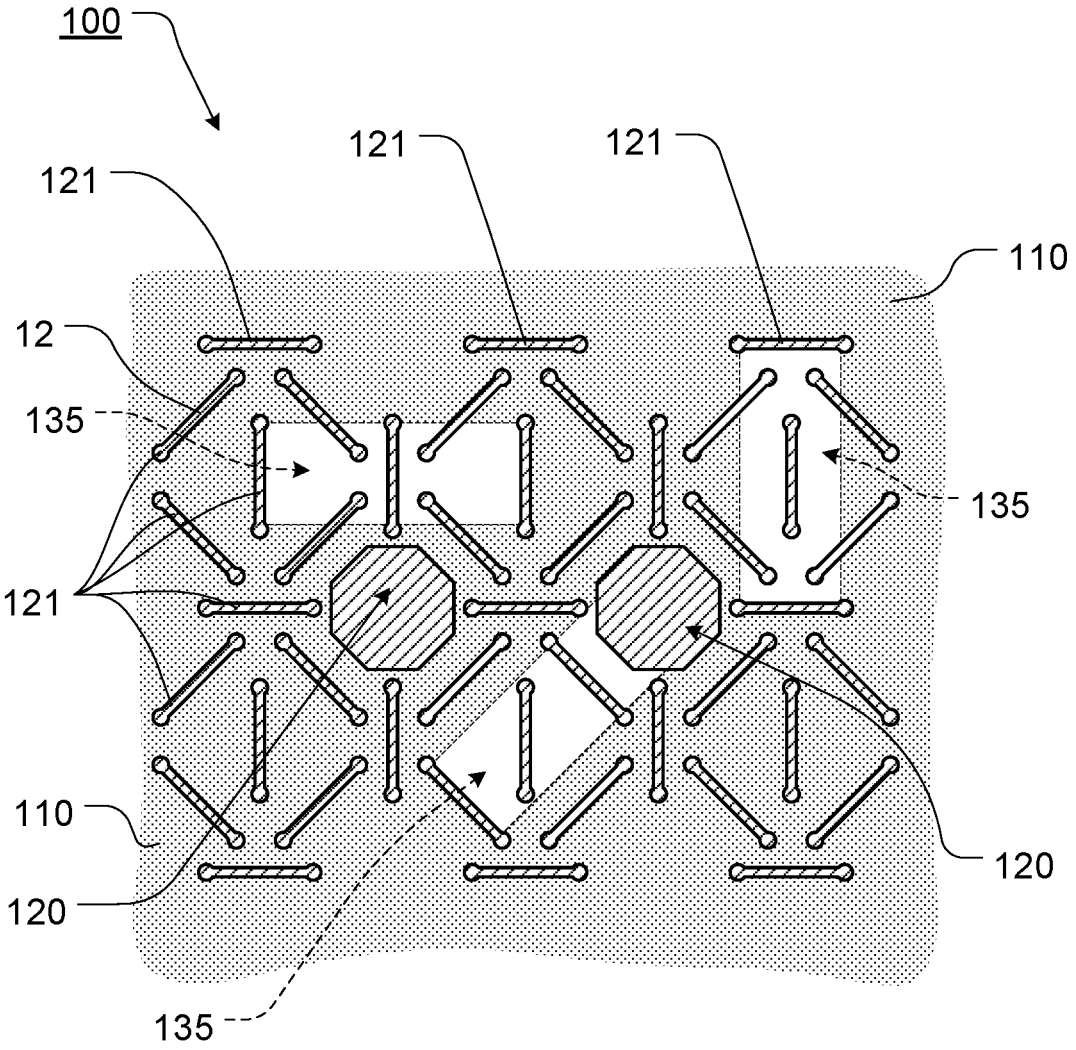
FIG. 24 illustrates an exemplary embodiment of the modular attachment matrix array attached or coupled to a carrier material, wherein the modular attachment matrix array comprises a plurality of substantially octagonally shaped matrix array apertures and a plurality of alternate matrix array apertures, arranged according to an exemplary embodiment of the presently disclosed systems, methods, and/or apparatuses.
Figure 25:
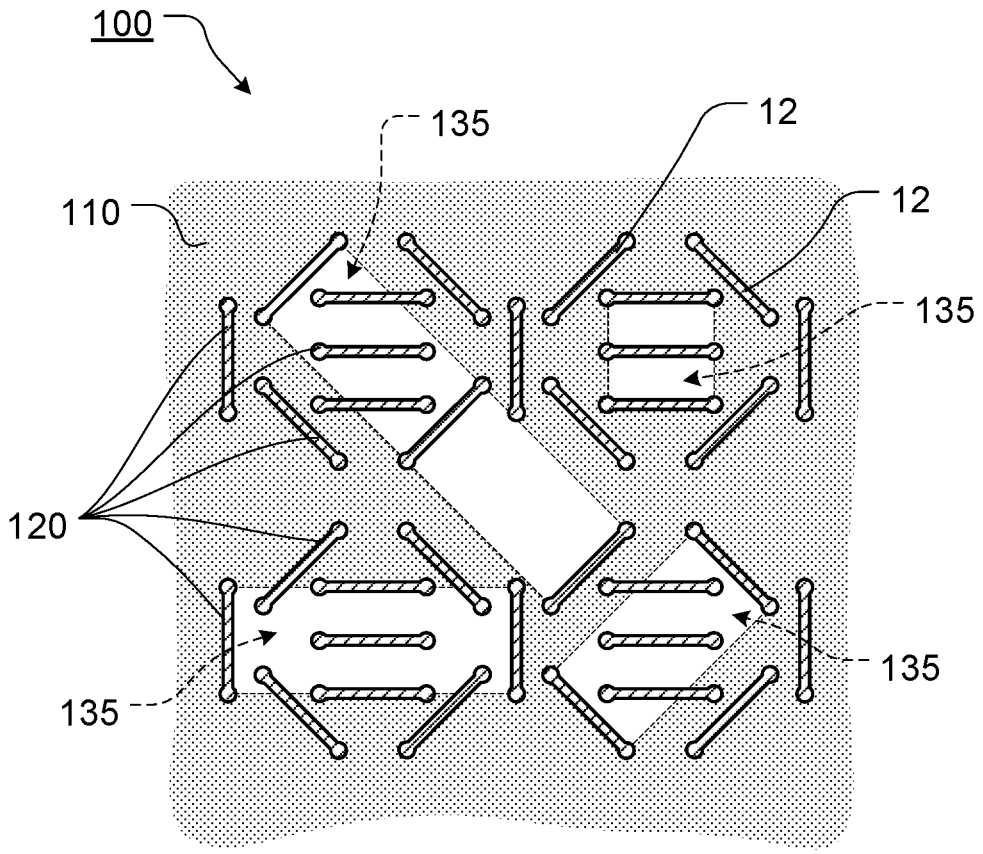
FIG. 25 illustrates an exemplary embodiment of the modular attachment matrix array attached or coupled to a carrier material, wherein the modular attachment matrix array comprises a plurality of matrix array apertures, arranged according to an exemplary embodiment of the presently disclosed systems, methods, and/or apparatuses.
Figure 27:
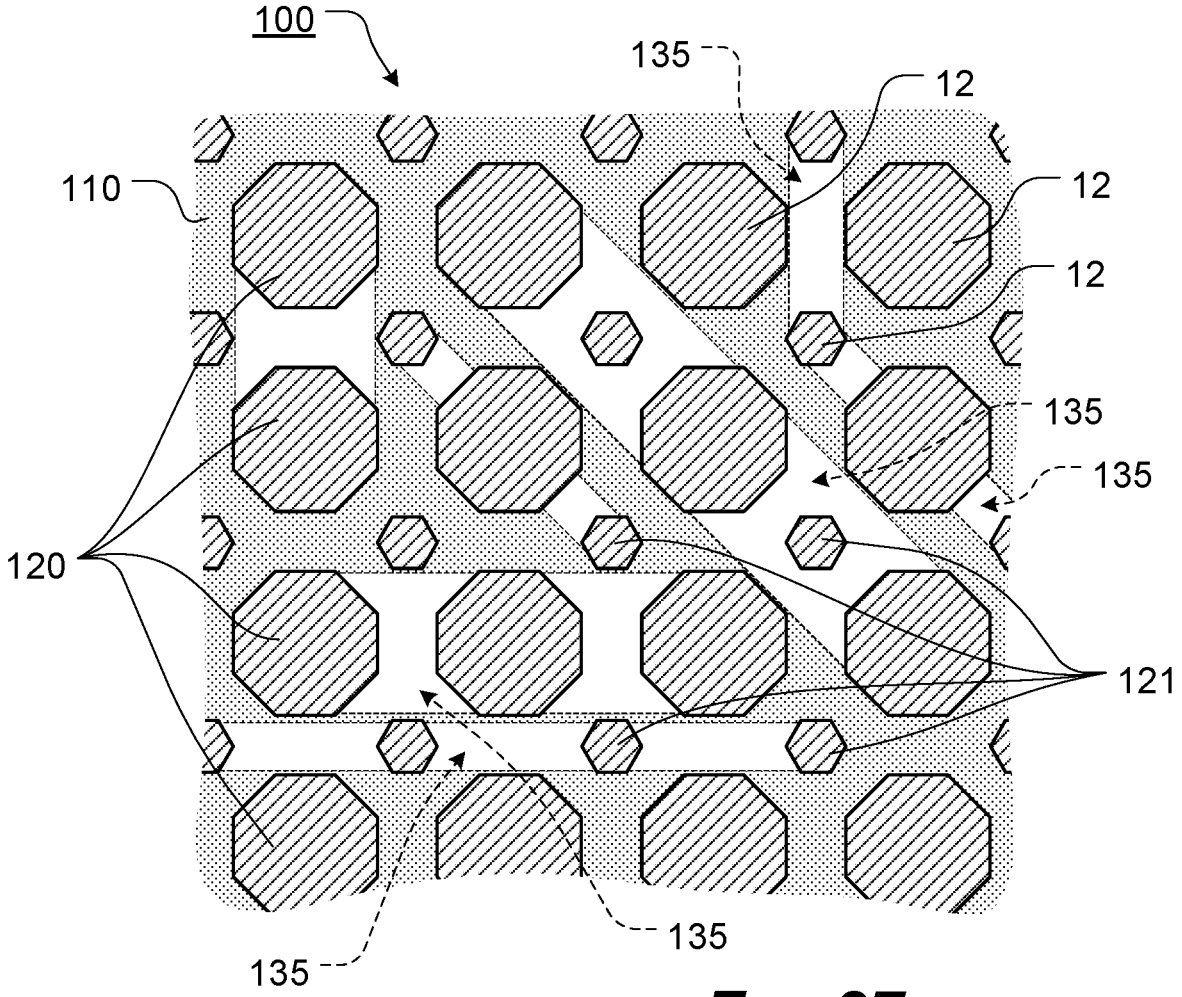
FIG. 27 illustrates the exemplary embodiment of the repeatable modular attachment matrix array pattern of FIG. 26 repeated as part of a matrix array layer, attached or coupled to a carrier material according to an exemplary embodiment of the presently disclosed systems, methods, and/or apparatuses.
Figure 28:
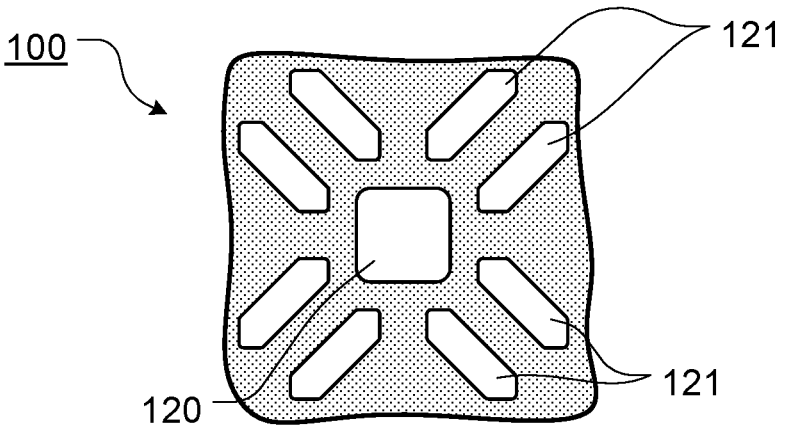
FIG. 28 illustrates an exemplary embodiment of a repeatable modular attachment matrix array pattern, arranged according to an exemplary embodiment of the presently disclosed systems, methods, and/or apparatuses.
Figure 29:
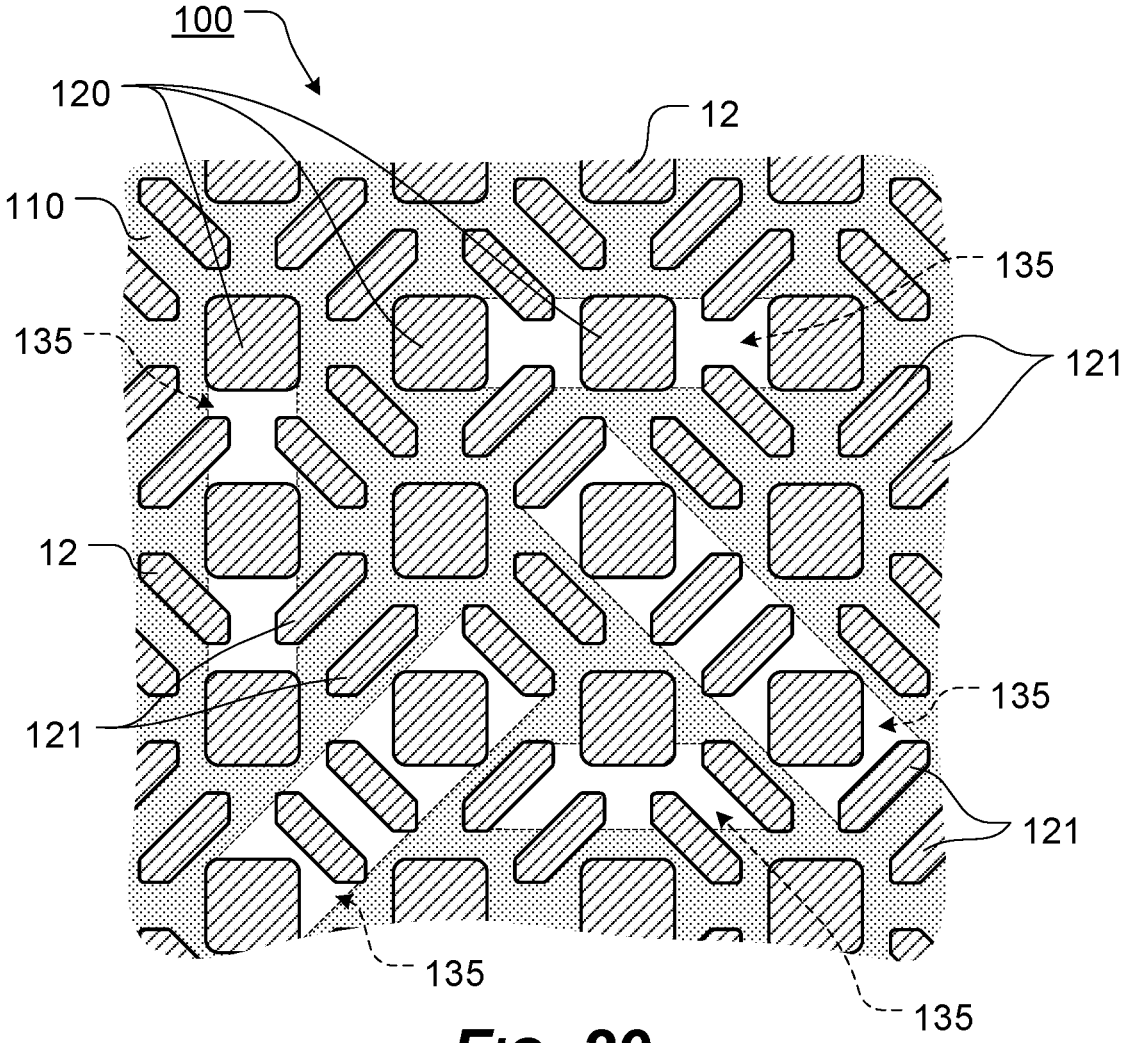
FIG. 29 illustrates the exemplary embodiment of the repeatable modular attachment matrix array pattern of FIG. 28 repeated as part of a matrix array layer, attached or coupled to a carrier material according to an exemplary embodiment of the presently disclosed systems, methods, and/or apparatuses.

In various exemplary embodiments, as illustrated in FIG. 4, the matrix array apertures 120 are generally formed as apertures through the matrix array layer 110. Each matrix array aperture 120 is defined by one or more continuous edges. In various exemplary embodiments, each matrix array aperture 120 may optionally be formed in the shape of an octagon. However, it should be appreciated that each of the matrix array apertures 120 may generally be formed in the shape of a triangle, a square (as illustrated in FIGS. 28-29), a rectangle, a pentagon, a hexagon (as illustrated in FIG. 13), a heptagon, an octagon (as illustrated in FIGS. 15-24, 26-27, and 30-31), a nanogon, a decagon, a pentadecagon, an icosagon, a circle (as illustrated in FIG. 14), an oval, a dumbbell/barbell shape (as illustrated in FIG. 25), or any other desired shape or configuration. Thus, it should be appreciated that the size and shape of each of the matrix array apertures 120 is a design choice based upon the desired functionality and/or appearance of the modular attachment matrix array 100 and/or the matrix array layer 110.

The size or diameter of each matrix array aperture 120 is also a design choice. In certain exemplary embodiments, the size or diameter of each matrix array aperture 120 is influenced or dictated by the width of the accessory coupling element of a compatible accessory, such as, for example, the accessory coupling element 88 of a compatible accessory 81. For example, if the accessory coupling element 88 has a width of approximately 1 inch, the size or diameter of each matrix array aperture 120 may optionally be approximately 1 inch, so as to allow the accessory coupling element 88 to be fitted within and interwoven between two or more matrix array apertures 120. Alternatively, the size or diameter of each matrix array aperture 120 may be created such that only certain accessories are compatible with the matrix array layer 110 and the modular attachment matrix array 100.

The matrix array apertures 120 are arranged in a repeating or semi-repeating series or sequence of spaced apart, repeating patterns. In various exemplary embodiments, the matrix array apertures 120 are arranged in a repeating or semi-repeating series or sequence of spaced apart rows 113 and columns 112. In various exemplary embodiments, the matrix array apertures 120 are arranged in a series of equally spaced rows 113 and equally spaced columns 112.

In certain exemplary embodiments, each of the rows 113 is spaced at a distance that is the same as the spacing between each of the columns 112. Alternatively, the spacing between each of the rows 113 is greater than or less than the spacing between each of the columns 112.

In various exemplary embodiments, the spacing between either edges or proximate centers of adjacent matrix array apertures 120 (whether vertically, horizontally, obliquely, or diagonally adjacent) is influenced or dictated by the width of the accessory webbing element 83 of a compatible accessory 81. For example, if the accessory webbing element 83 has a width of approximately 1 inch, the spacing between either edges or proximate centers of adjacent matrix array apertures 120 may optionally be approximately 1 inch, so as to allow the accessory webbing element(s) 83 to be appropriately aligned between every other matrix array aperture 120 in a vertical, horizontal, oblique, or diagonal direction. Alternatively, the spacing between either edges or proximate centers of adjacent matrix array apertures 120 may be created such that only certain accessories are compatible with the matrix array layer 110 and the modular attachment matrix array 100.

It should be appreciated that two or more adjacent matrix array apertures 120 may comprise a row 113 and two or more adjacent matrix array apertures 120 may comprise a column 112. Thus, it should be appreciated that the number of matrix array apertures 120 formed in the matrix array layer 110 is a design choice based upon the desired size and/or functionality of the matrix array layer 110.

Figure 18:
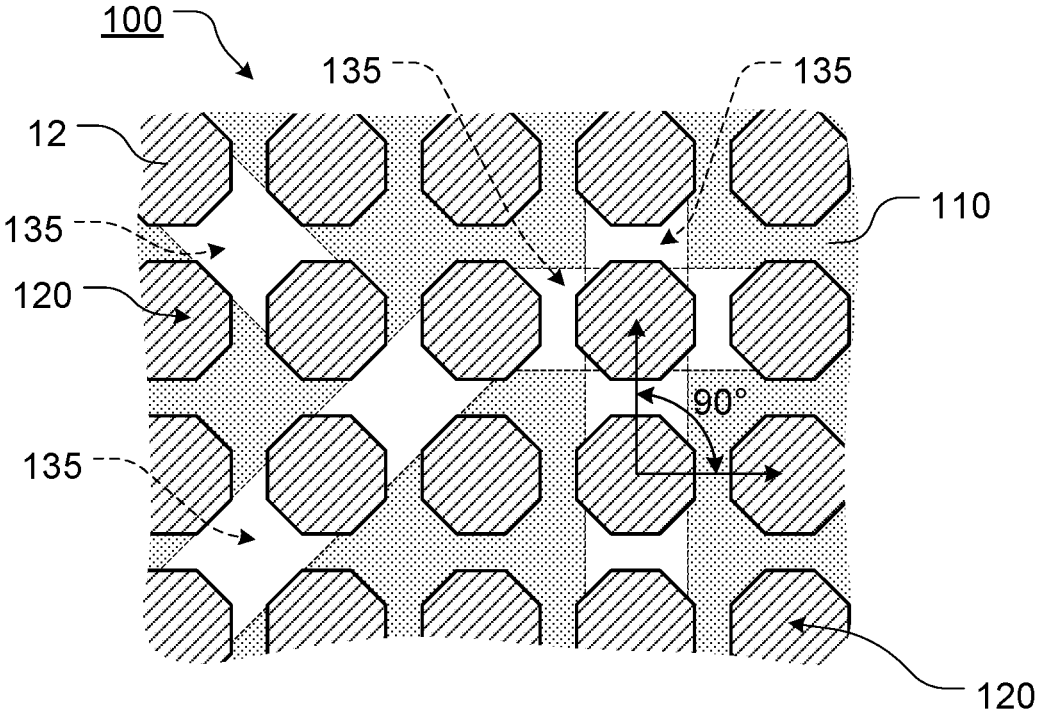
FIG. 18 illustrates an exemplary embodiment of the modular attachment matrix array attached or coupled to a carrier material, wherein the modular attachment matrix array comprises a plurality of substantially octagonally shaped matrix array apertures, arranged according to an exemplary embodiment of the presently disclosed systems, methods, and/or apparatuses.

In various exemplary, nonlimiting embodiments, each adjacent row 113 and/or column 112 of spaced apart matrix array apertures 120 is offset such that either edges or proximate centers of adjacent matrix array apertures 120 are offset by approximately ±45° (as illustrated in FIG. 4) or approximately ±90° (as illustrated in FIG. 18). If for example, either edges or proximate centers of adjacent matrix array apertures 120 are offset by ±45° or ±90°, an attached or coupled accessory 81 can be attached or coupled at least at ±0°, ±90°, or ±45°. Thus, it should be appreciated that the offset of adjacent rows 113 and/or columns 112 dictates the angle of oblique attachment of accessories.

In certain exemplary, nonlimiting embodiments, each matrix array aperture 120 is separated from each other matrix array aperture 120 by a distance that is equal to or greater than a width of each matrix array aperture 120.

By arranging the matrix array apertures 120 in a repeating or semi-repeating series or sequence, matrix array tunnel segments 135 are created between adjacent matrix array apertures 120 (whether vertically, horizontally, obliquely, or diagonally adjacent).

In certain exemplary embodiments, alternate attachment apertures 121 are optionally formed in portions of the matrix array layer 110. For example, as illustrated, the alternate attachment apertures 121 may comprise apertures formed at spaced apart locations of the matrix array layer 110. The alternate attachment apertures 121 may allow for alternate means of attachment between the matrix array layer 110 and one or more desired accessories.

Figure 20:
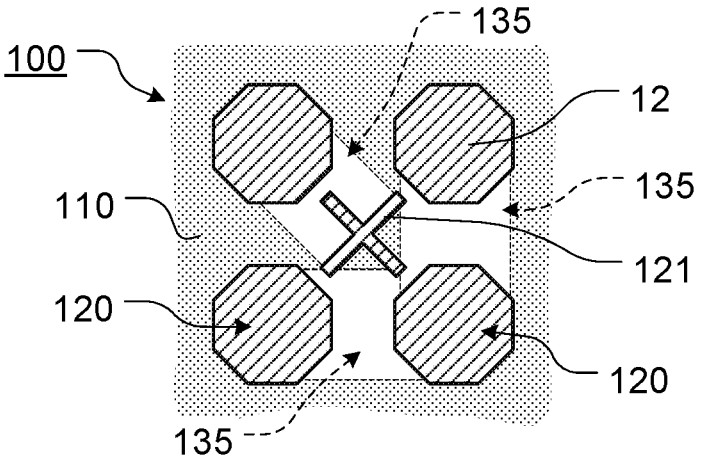
FIG. 20 illustrates an exemplary embodiment of the modular attachment matrix array attached or coupled to a carrier material, wherein the modular attachment matrix array comprises a plurality of substantially octagonally shaped matrix array apertures and at least one alternate matrix array aperture, arranged according to an exemplary embodiment of the presently disclosed systems, methods, and/or apparatuses.
Figure 21:
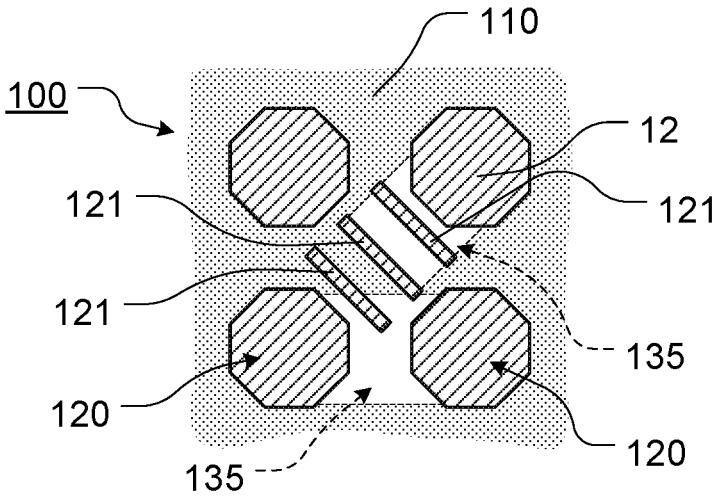
FIG. 21 illustrates an exemplary embodiment of the modular attachment matrix array attached or coupled to a carrier material, wherein the modular attachment matrix array comprises a plurality of substantially octagonally shaped matrix array apertures and a plurality of alternate matrix array apertures, arranged according to an exemplary embodiment of the presently disclosed systems, methods, and/or apparatuses.
Figure 22:
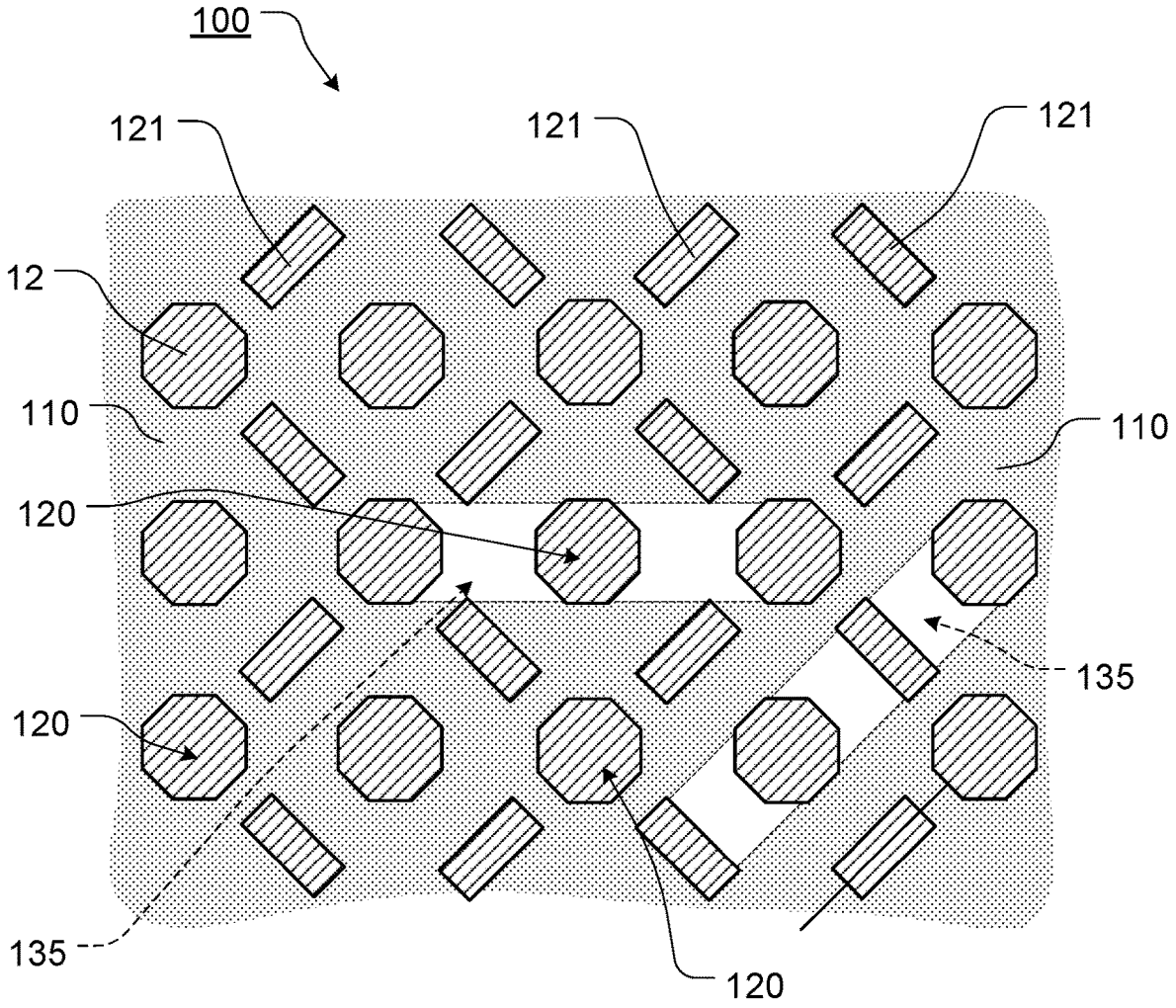
FIG. 22 illustrates an exemplary embodiment of the modular attachment matrix array attached or coupled to a carrier material, wherein the modular attachment matrix array comprises a plurality of substantially octagonally shaped matrix array apertures and a plurality of alternate matrix array apertures, arranged according to an exemplary embodiment of the presently disclosed systems, methods, and/or apparatuses.
Figure 23:
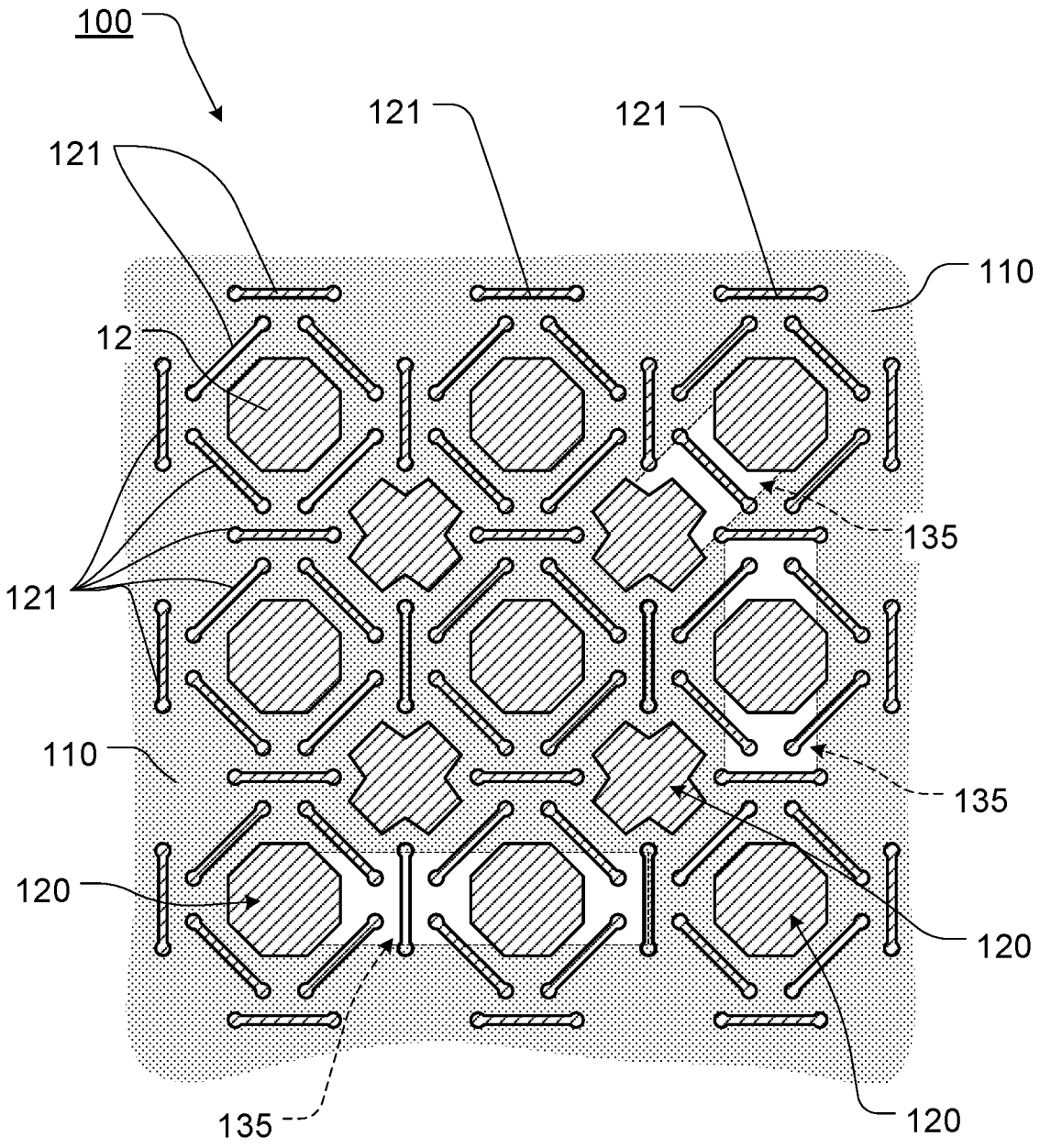
FIG. 23 illustrates an exemplary embodiment of the modular attachment matrix array attached or coupled to a carrier material, wherein the modular attachment matrix array comprises a plurality of substantially octagonally shaped matrix array apertures and a plurality of alternate matrix array apertures, arranged according to an exemplary embodiment of the presently disclosed systems, methods, and/or apparatuses.
Figure 26:
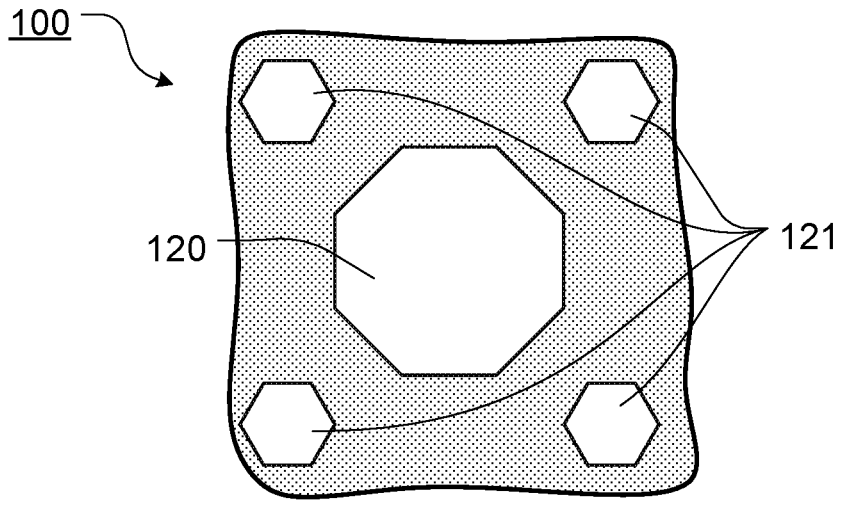
FIG. 26 illustrates an exemplary embodiment of a repeatable modular attachment matrix array pattern, arranged according to an exemplary embodiment of the presently disclosed systems, methods, and/or apparatuses.

In various exemplary embodiments, the alternate attachment apertures 121 are generally formed in the shape of a circle (as illustrated in FIGS. 3-14). However, it should be appreciated that each of the alternate attachment apertures 121 may generally be formed in the shape of a triangle, a square, a rectangle (as illustrated in FIGS. 21-22), a pentagon, a hexagon (as illustrated in FIGS. 26-27), an elongate hexagon (as illustrated in FIGS. 28-31), a heptagon, an octagon, a nanogon, a decagon, a pentadecagon, an icosagon, an oval, a dumbbell/barbell shape (as illustrated in FIGS. 23-24), an "x" (as illustrated in FIG. 20), or any other desired shape or configuration. Thus, it should be appreciated that the size and shape of each of the alternate attachment apertures 121 is a design choice based upon the desired functionality and/or appearance of the modular attachment matrix array 100 and/or the matrix array layer 110.

It is possible for the matrix array layer 110 to operate as a stand-alone element, such as, for example, a sheet of matrix array layer 110 material, to which compatible accessories may be attached or coupled. However, in various exemplary embodiments, the matrix array layer 110 is at least partially attached or coupled to at least a portion of a carrier or carrier material, such as, for example, a carrier material 12. Thus, the matrix array layer 110 may be at least partially attached or coupled to an exemplary carrier (such as, for example, exemplary carrier material 12), for example, an article of clothing, a vest, a plate carrier, a backpack, a pack, a bag, a platform, or another flexible, semi-rigid, or rigid carrier.

As illustrated, for example, in FIGS. 3 and 5-12, the matrix array layer 110 is illustrated as comprising a somewhat rectangular portion of matrix array layer 110 material that is at least partially attached or coupled to an exemplary bag. As illustrated, the matrix array layer 110 is attached or coupled to a portion of the exemplary bag by matrix array layer attachment elements 130, such as stitching proximate a perimeter of the matrix array layer 110. The matrix array layer 110 may then optionally be further attached or coupled to the carrier material 12, via additional matrix array layer attachment elements 130. The matrix array layer attachment elements 130 are spaced apart, as necessary or desirable, in order to further secure, attach, or couple the matrix array layer 110 to the carrier material 12. The number and placement of additional matrix array layer attachment elements 130 is a design choice based upon the desired level of securement of the matrix array layer 110 to the carrier material 12 and/or to further ensure that the matrix array layer 110 will not separate or pull away from the carrier material 12, particularly if accessories are attached or coupled to the matrix array layer 110.

In certain exemplary embodiments, the matrix array layer attachment elements 130 comprise stitching. Alternatively, the matrix array layer 110 may be attached or coupled to the carrier material 12 at one or more matrix array layer attachment elements 130 via adhesive bonding, welding, screws, rivets, pins, mating hook and loop portions, snap or releasable fasteners, or other known or later developed means or methods for permanently or releasably attaching or coupling the matrix array layer 110 to the carrier material 12. The one or more matrix array layer attachment elements 130 may be formed or positioned proximate a perimeter of the matrix array layer 110 or in one or more areas located within the one or more matrix array layers 110.

In addition to the variability of size and shape of the matrix array layer 110, the orientation of the matrix array layer 110, relative to the carrier material 12, is also a design choice. Thus, as illustrated in FIGS. 3 and 5-12, the matrix array layer 110 is illustrated as being attached or coupled to the carrier material 12, such that the rows 113 of matrix array apertures 120 are substantially parallel to the longitudinal axis, along the length, of the exemplary bag, while the columns 112 of matrix array apertures 120 are substantially perpendicular to the longitudinal axis of the exemplary bag. It should be appreciated that this is merely exemplary and the matrix array layer 110 may be attached at any desired angular or rotational orientation relative to a surface of the bag or carrier material 12.

The portions of material of the matrix array layer 110 between adjacent matrix array apertures 120 form matrix array tunnel segments 135. If the matrix array layer 110 is attached to a carrier material 12, the matrix array tunnel segments 135 are formed between the matrix array layer 110 and the surface of the carrier material 12. The matrix array tunnel segments 135 provide areas for securing the accessory coupling element 88 of an accessory 81 to the matrix array layer 110. In this manner, an accessory coupling element 88 may be interwoven between the aligned matrix array tunnel segments 135 to removably attach the accessory 81 to the carrier material 12.

Figure 7:
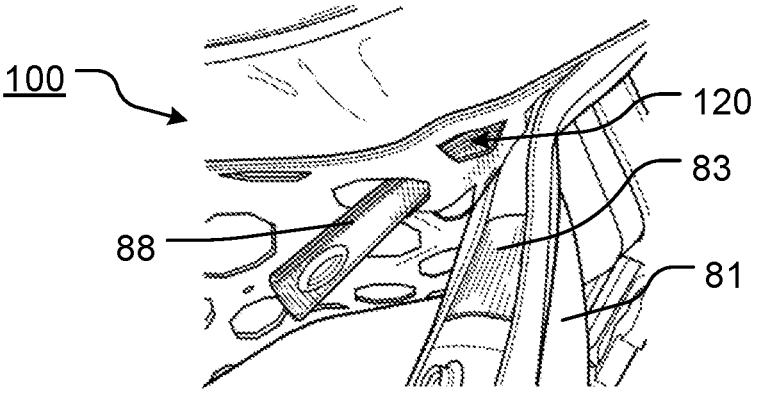
FIG. 7 illustrates a more detailed view of the interaction between the matrix array layer of the modular attachment matrix array and the accessory coupling element of an exemplary accessory, according to the presently disclosed systems, methods, and/or apparatuses.
Figure 8:
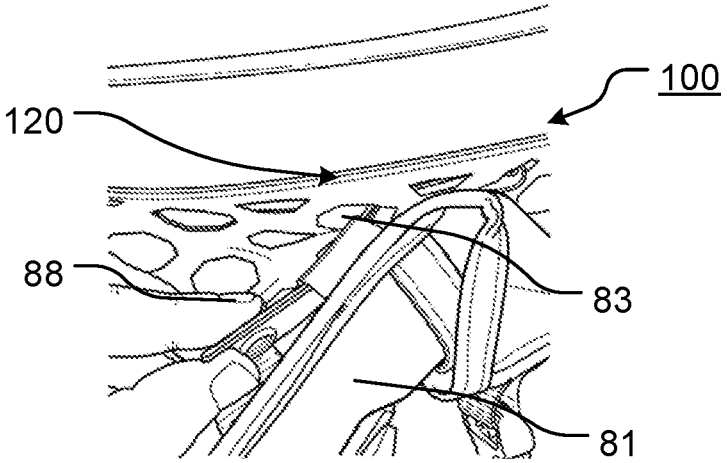
FIG. 8 illustrates a more detailed view of the interaction between the matrix array layer of the modular attachment matrix array, the accessory coupling element of an exemplary accessory, and the accessory webbing element of the exemplary accessory, according to the presently disclosed systems, methods, and/or apparatuses.
Figure 9:
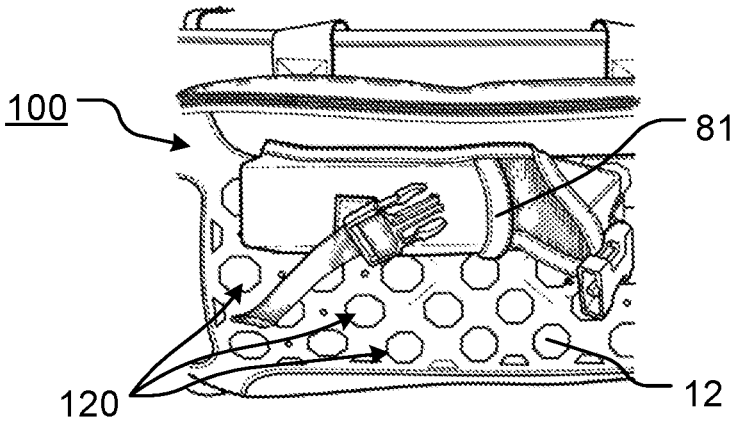
FIG. 9 illustrates an exemplary accessory attached or coupled to the matrix array layer of the modular attachment matrix array, according to the presently disclosed systems, methods, and/or apparatuses.
Figure 10:
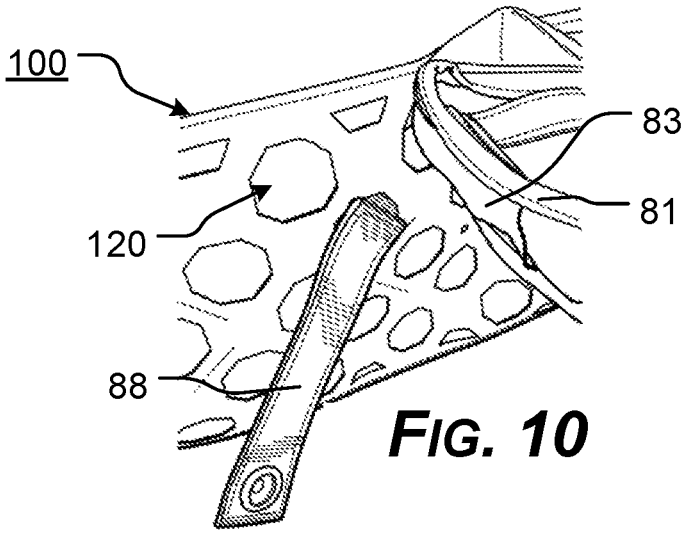
FIG. 10 illustrates a more detailed view of the interaction between the matrix array layer of the modular attachment matrix array and the accessory coupling element of an exemplary accessory, according to the presently disclosed systems, methods, and/or apparatuses.
Figure 11:
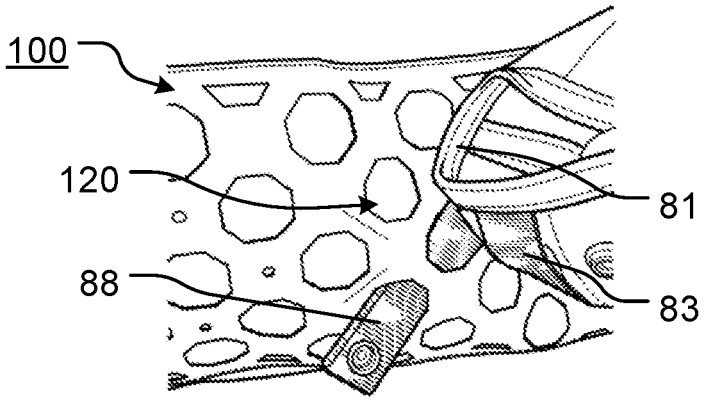
FIG. 11 illustrates a more detailed view of the interaction between the matrix array layer of the modular attachment matrix array and the accessory coupling element of an exemplary accessory, according to the presently disclosed systems, methods, and/or apparatuses.
Figure 12:
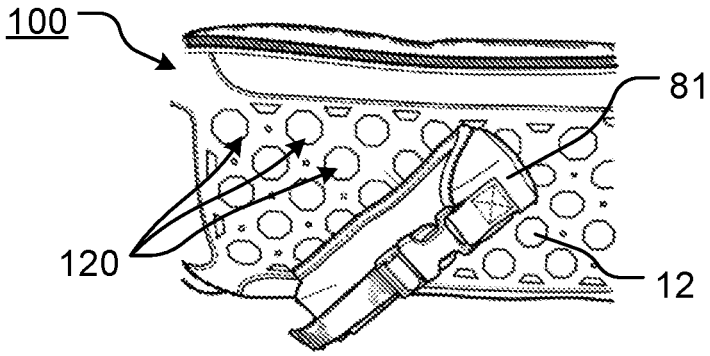
FIG. 12 illustrates an exemplary accessory attached or coupled to the matrix array layer of the modular attachment matrix array, according to the presently disclosed systems, methods, and/or apparatuses.

During attachment of an exemplary accessory 81, as illustrated most clearly in FIGS. 5-12, the accessory 81 is aligned with the matrix array layer 110 in a desired orientation. As illustrated in FIGS. 5-12, the accessory 81 may optionally be aligned with the matrix array layer 110 in a generally vertical manner, as illustrated in FIGS. 7-9, the accessory 81 may optionally be aligned with the matrix array layer 110 in a generally horizontal manner, or as illustrated in FIGS. 10-12, the accessory 81 may optionally be aligned with the matrix array layer 110 in a generally oblique or diagonal manner. It should be understood that these orientations are relative to the orientation of the matrix array layer 110 and the orientation of the matrix array layer 110 relative to the carrier material 12.

As further illustrated, the exemplary accessory 81 includes one or more substantially parallel, spaced apart accessory webbing elements 83. If more than one accessory webbing element 83 is included, the accessory webbing elements 83 are spaced apart so as to correspond to the spaces between the spaced apart matrix array apertures 120.

When the accessory 81 is placed adjacent the matrix array layer 110 such that at least a portion of the accessory webbing elements 83 are within a portion of the spaces between the spaced apart matrix array apertures 120 (and at least a portion of the matrix array apertures 120 are within the spaces between the spaced apart accessory webbing elements 83) and corresponding matrix array tunnel segments 135 and accessory tunnel segments 87 are aligned, the accessory coupling element 88 may be interwoven between the aligned matrix array tunnel segments 135 and accessory tunnel segments 87 (alternating between adjacent matrix array apertures 120 and/or alternate attachment apertures 121 of the matrix array layer 110 and accessory webbing elements 83 on the accessory 81) to removably attach the accessory 81 to the matrix array layer 110.

Thus, an accessory 81 may be mounted to the matrix array layer 110 in a variety of orientations. Likewise, if a particular carrier material 12 includes a matrix array layer 110, a variety of accessories may be interchangeably mounted to the matrix array layer 110 to accommodate a variety of desired configurations.

It should be appreciated that a more detailed explanation of the instructions regarding how to interweave the accessory coupling element 88 between the matrix array apertures 120 and accessory webbing elements 83 is not provided herein because, while the matrix array layer 110 provides more orientation options and other features, accessories are generally attached to the matrix array layer 110 in a manner similar to the manner in which accessories are attached to a portion of MOLLE webbing. Therefore, it is believed that the level of description provided herein is sufficient to enable one of ordinary skill in the art to understand and practice the systems, methods, and apparatuses, as described.

FIGS. 13-31 illustrate various exemplary embodiments of a matrix array layer 110 and a modular attachment matrix array 100, according to the present disclosure. As illustrated, the modular attachment matrix array 100 includes a matrix array layer 110 having two or more matrix array apertures 120 formed therethrough at spaced apart locations and arranged in one or more rows 113 and/or columns 112. The matrix array layer 110 is at least partially attached or coupled to a carrier material 12 and tunnel segments 135 are formed between adjacent matrix array apertures 120. Additional, optional alternate attachment apertures 121 are also formed in the matrix array layer 110.

It should be understood that each of these elements corresponds to and operates similarly to the modular attachment matrix array 100, matrix array layer 110, matrix array apertures 120, tunnel segments 135, and alternate attachment apertures 121, as described above with reference to the modular attachment matrix array 100 of FIGS. 3-12.

However, FIG. 13 illustrates an exemplary embodiment of the modular attachment matrix array 100, wherein the modular attachment matrix array 100 comprises substantially hexagonally shaped matrix array apertures 120, while FIG. 14 illustrates an exemplary embodiment of the modular attachment matrix array 100, wherein the modular attachment matrix array 100 comprises substantially circular shaped matrix array apertures 120.

Figure 15:
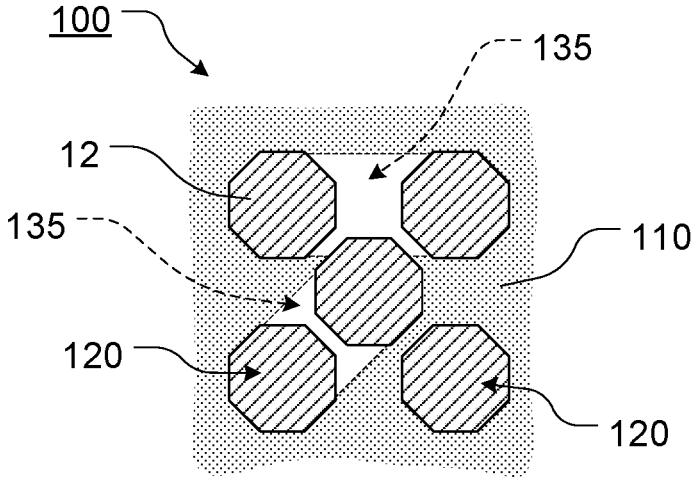
FIG. 15 illustrates an exemplary embodiment of the modular attachment matrix array attached or coupled to a carrier material, wherein the modular attachment matrix array comprises substantially octagonally shaped matrix array apertures, arranged according to an exemplary embodiment of the presently disclosed systems, methods, and/or apparatuses.
Figure 16:
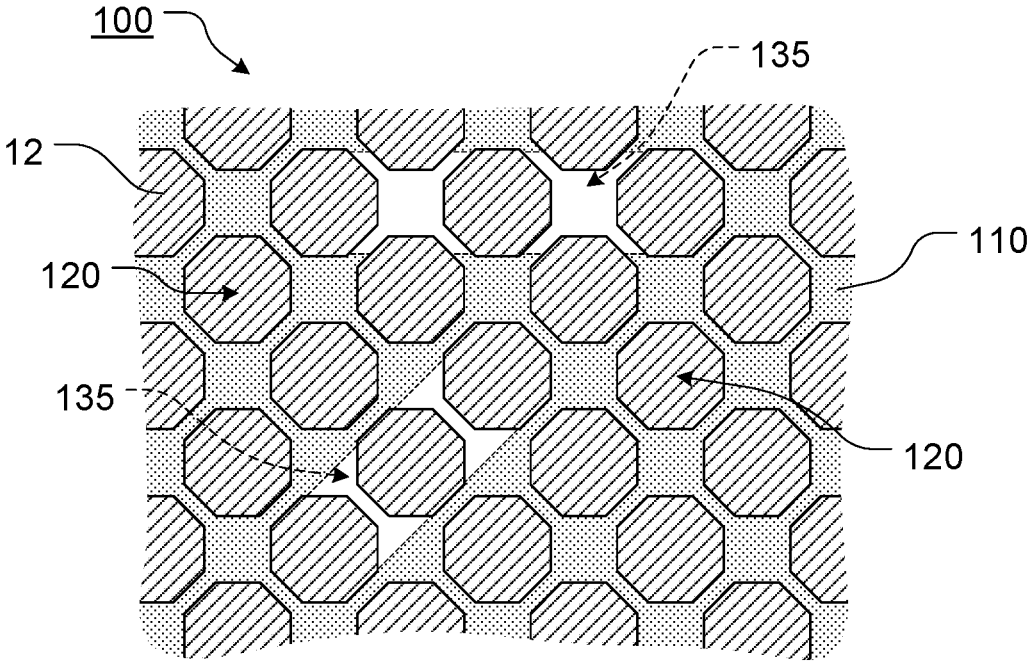
FIG. 16 illustrates an exemplary embodiment of the modular attachment matrix array attached or coupled to a carrier material, wherein the modular attachment matrix array comprises a plurality of substantially octagonally shaped matrix array apertures, arranged according to an exemplary embodiment of the presently disclosed systems, methods, and/or apparatuses.

FIG. 15 illustrates an exemplary embodiment of the modular attachment matrix array 100 attached or coupled to a carrier material 12. As illustrated, the modular attachment matrix array 100 comprises five substantially octagonally shaped matrix array apertures 120, arranged or grouped such that exemplary tunnel segments 135 are formed in a relatively horizontal, relatively vertical, and relatively diagonal manner. FIG. 16 illustrates an exemplary embodiment of the modular attachment matrix array 100 attached or coupled to a carrier material 12, wherein the modular attachment matrix array 100 comprises a plurality of substantially octagonally shaped matrix array apertures 120, as illustrated in FIG. 15. However, as illustrated in FIG. 16, the grouping of five matrix array apertures 120 is expanded to a plurality of arranged matrix array apertures 120. Therefore, it should be appreciated that the total number of matrix array apertures 120 used to form the modular attachment matrix array 100 of the matrix array layer 110 is a design choice, based upon the desired area that the modular attachment matrix array 100 is to cover, whether attached to a carrier material 12 or as a standalone matrix array layer 110.

Figure 17:
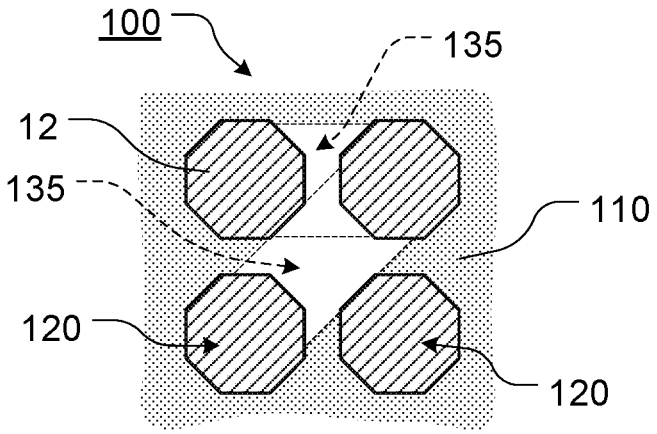
FIG. 17 illustrates an exemplary embodiment of the modular attachment matrix array attached or coupled to a carrier material, wherein the modular attachment matrix array comprises a plurality of substantially octagonally shaped matrix array apertures, arranged according to an exemplary embodiment of the presently disclosed systems, methods, and/or apparatuses.

FIG. 17 illustrates an exemplary embodiment of the modular attachment matrix array 100 attached or coupled to a carrier material 12, wherein the modular attachment matrix array 100 comprises four, spaced apart, substantially octagonally shaped matrix array apertures 120. As illustrated, the positioning of the matrix array apertures 120 still provides relatively horizontal, relatively vertical, and relatively diagonal tunnel segments 135. It should be appreciated that the arrangement or grouping of matrix array apertures 120, as illustrated in FIG. 17, may be duplicated to create a matrix array layer 110 of any desired size and including any number of desired matrix array apertures 120, as illustrated, for example, in FIG. 18.

Figure 19:
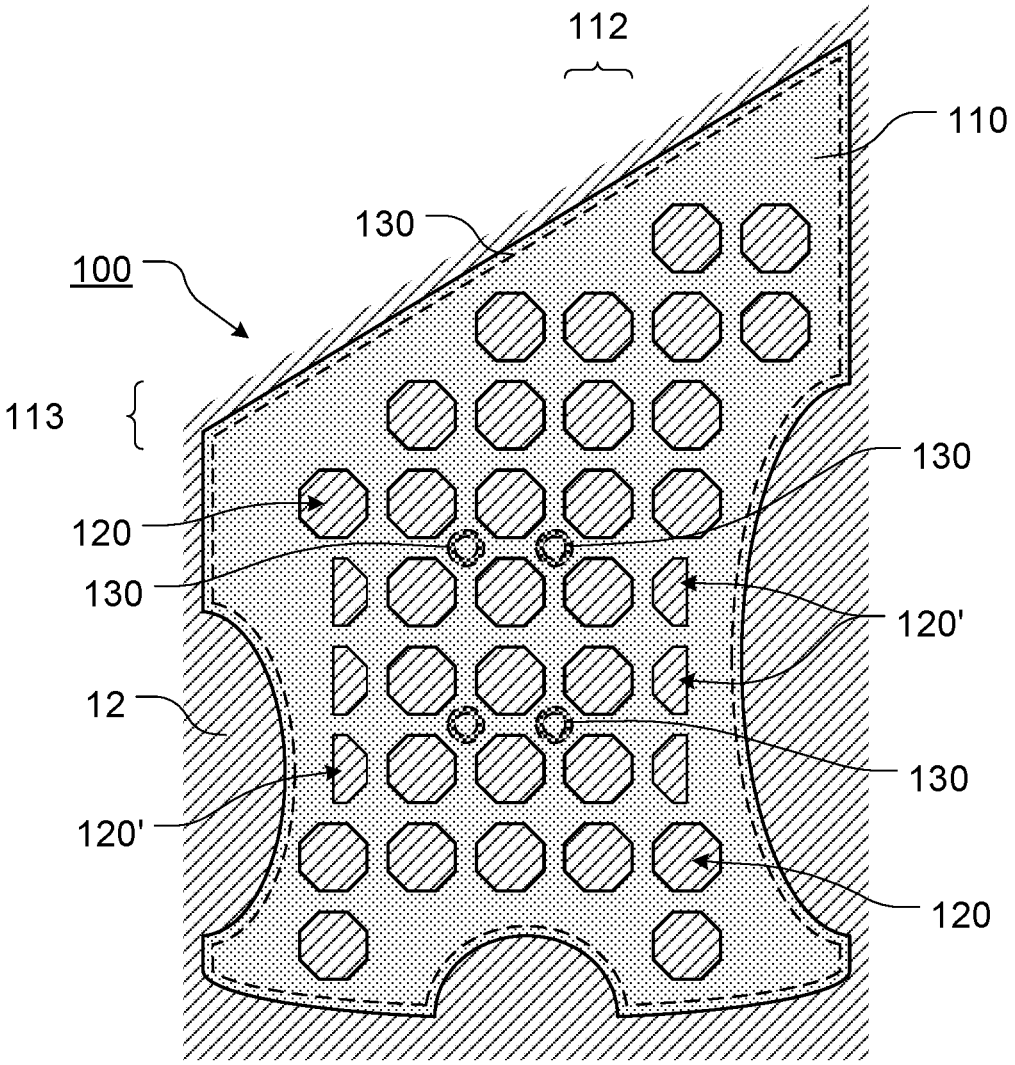
FIG. 19 illustrates an exemplary embodiment of a portion of the modular attachment matrix array attached or coupled to an exemplary carrier material, wherein the modular attachment matrix array comprises a plurality of substantially octagonally shaped matrix array apertures, arranged according to an exemplary embodiment of the presently disclosed systems, methods, and/or apparatuses.

As further illustrated in FIG. 19, the arrangement or grouping of matrix array apertures 120 may be applied to the matrix array layer 110 in any desired arrangement. For example, while the matrix array apertures 120 are arranged in a repeating or semi-repeating series or sequence of equally spaced rows 113 and equally spaced columns 112, the length of each row 113 or column 112 may be varied to produce a desired arrangement of matrix array apertures 120.

As further illustrated in FIG. 19, the arrangement or grouping of matrix array apertures 120 includes a number of partial matrix array apertures 120'. Each partial matrix array aperture 120' is formed of a partial or incomplete matrix array aperture. While the partial matrix array apertures 120' are each illustrated as being positioned at a beginning or end of a given row 113, it should be appreciated that partial matrix array apertures 120' may optionally be included at a beginning or an end of one or more rows 113, one or more columns 112, or within a given row 113 or column 112.

FIG. 20 illustrates an exemplary embodiment of the modular attachment matrix array 100 attached or coupled to a carrier material 12, wherein the modular attachment matrix array 100 comprises four, spaced apart, substantially octagonally shaped matrix array apertures 120 and at least one alternate matrix array aperture 121 formed in a relative center of the grouping of four matrix array apertures 120. As illustrated, the alternate matrix array aperture 121 comprises a substantially "X" or "+" shaped aperture. By utilizing such an alternate matrix array aperture 121, diagonal tunnel segments 135 may be formed between diagonally positioned matrix array apertures 120, diagonally positioned alternate matrix array apertures 121, and diagonally positioned matrix array apertures 120 and alternate matrix array apertures 121. Depending upon the flexibility of the matrix array layer 110, tunnel segments 135, such as the exemplary tunnel segments 135 illustrated, may be joined and utilized between horizontally, vertically, or diagonally positioned alternate matrix array apertures 121 and/or matrix array apertures 120.

It should be appreciated that the arrangement or grouping of four matrix array apertures 120 and a substantially "X" or "+" shaped alternate matrix array aperture 121, as illustrated in FIG. 20, may be duplicated to create a matrix array layer 110 of any desired size and including any number of desired matrix array apertures 120 and alternate matrix array apertures 121.

FIG. 21 illustrates an exemplary embodiment of the modular attachment matrix array 100 attached or coupled to a carrier material 12, wherein the modular attachment matrix array 100 comprises four, spaced apart, substantially octagonally shaped matrix array apertures 120 and a plurality of alternate matrix array apertures 121 formed in a relative center of the grouping of four matrix array apertures 120. As illustrated, the alternate matrix array apertures 121 comprise a series of parallel slots, formed through the matrix array layer 110. By utilizing such a series of alternate matrix array apertures 121, diagonal tunnel segments 135 may be formed between diagonally positioned matrix array apertures 120, diagonally positioned alternate matrix array apertures 121, and diagonally positioned matrix array apertures 120 and alternate matrix array apertures 121. Tunnel segments 135, such as the exemplary tunnel segments 135 illustrated, may be joined and utilized between horizontally, vertically, or diagonally positioned alternate matrix array apertures 121 and/or matrix array apertures 120.

It should be appreciated that the arrangement or grouping of four matrix array apertures 120 and a plurality of alternate matrix array apertures 121 formed in a relative center of the grouping of four matrix array apertures 120, as illustrated in FIG. 21, may be duplicated to create a matrix array layer 110 of any desired size and including any number of desired matrix array apertures 120 and alternate matrix array apertures 121.

FIG. 22 illustrates an exemplary embodiment of the modular attachment matrix array 100 attached or coupled to a carrier material 12, wherein the modular attachment matrix array 100 comprises a plurality of spaced apart, substantially octagonally shaped matrix array apertures 120 and a plurality of alternate matrix array apertures 121 formed in a repeating "X" or zigzag pattern relative to the spaced apart matrix array apertures 120. As illustrated, the alternate matrix array apertures 121 comprise a series of diagonally alternating slots, formed through the matrix array layer 110. By utilizing such a series of diagonally alternating alternate matrix array apertures 121, diagonal tunnel segments 135 may be formed between diagonally positioned matrix array apertures 120, diagonally positioned alternate matrix array apertures 121, and diagonally positioned matrix array apertures 120 and alternate matrix array apertures 121. Tunnel segments 135, such as the exemplary tunnel segments 135 illustrated, may be joined and utilized between horizontally, vertically, or diagonally positioned alternate matrix array apertures 121 and/or matrix array apertures 120.

It should be appreciated that the arrangement or grouping of matrix array apertures 120 and diagonally alternating alternate matrix array apertures 121, as illustrated in FIG. 22, may be duplicated to create a matrix array layer 110 of any desired size and including any number of desired matrix array apertures 120 and alternate matrix array apertures 121.

FIG. 23 illustrates an exemplary embodiment of the modular attachment matrix array 100 attached or coupled to a carrier material 12, wherein the modular attachment matrix array 100 comprises a plurality of spaced apart, substantially octagonally shaped matrix array apertures 120, a plurality of "X or "+" shaped matrix array apertures 120', and a plurality of horizontal, vertical, and diagonal slot or dumbbell/barbell shaped alternate matrix array apertures 121 formed in a repeating pattern. By utilizing such a repeated series of alternating substantially octagonally shaped matrix array apertures 120, "X or "+" shaped matrix array apertures 120', and slot or dumbbell/barbell shaped alternate matrix array apertures 121, tunnel segments 135, such as the exemplary tunnel segments 135 illustrated, may be joined and utilized between horizontally, vertically, or diagonally positioned matrix array apertures 120.

It should be appreciated that the arrangement or grouping of substantially octagonally shaped matrix array apertures 120, "X or "+" shaped matrix array apertures 120', and slot or dumbbell/barbell shaped alternate matrix array apertures 121, as illustrated in FIG. 23, may be duplicated to create a matrix array layer 110 of any desired size and including any number of desired matrix array apertures 120 and alternate matrix array apertures 121.

FIG. 24 illustrates an exemplary embodiment of the modular attachment matrix array 100 attached or coupled to a carrier material 12, wherein the modular attachment matrix array 100 comprises a plurality of spaced apart, substantially octagonally shaped matrix array apertures 120 and a plurality of horizontal, vertical, and diagonal slot or dumbbell/barbell shaped alternate matrix array apertures 121 formed in a repeating pattern. By utilizing such a repeated series of alternating substantially octagonally shaped matrix array apertures 120 and slot or dumbbell/barbell shaped alternate matrix array apertures 121, tunnel segments 135, such as the exemplary tunnel segments 135 illustrated, may be joined and utilized between horizontally, vertically, or diagonally positioned matrix array apertures 120.

It should be appreciated that the arrangement or grouping of substantially octagonally shaped matrix array apertures 120 and slot or dumbbell/barbell shaped alternate matrix array apertures 121, as illustrated in FIG. 24, may be duplicated to create a matrix array layer 110 of any desired size and including any number of desired matrix array apertures 120 and alternate matrix array apertures 121.

FIG. 25 illustrates an exemplary embodiment of the modular attachment matrix array 100 attached or coupled to a carrier material 12, wherein the modular attachment matrix array 100 comprises a plurality of spaced apart horizontal, vertical, and diagonal slot or dumbbell/barbell shaped matrix array apertures 120 formed in a repeating pattern. By utilizing such a repeated series of alternating substantially slot or dumbbell/barbell shaped matrix array apertures 120, tunnel segments 135, such as the exemplary tunnel segments 135 illustrated, may be joined and utilized between horizontally, vertically, or diagonally positioned matrix array apertures 120.

It should be appreciated that the arrangement or grouping of slot or dumbbell/barbell shaped matrix array apertures 120, as illustrated in FIG. 25, may be duplicated to create a matrix array layer 110 of any desired size and including any number of desired matrix array apertures 120 and alternate matrix array apertures 121.

FIG. 26 illustrates an exemplary embodiment of a repeatable modular attachment matrix array 100 pattern and FIG. 27 illustrates the exemplary embodiment of the repeatable modular attachment matrix array 100 pattern of FIG. 26 repeated as part of a matrix array layer 110, attached or coupled to a carrier material 12.

As illustrated in FIGS. 26 and 27, the exemplary modular attachment matrix array 100 comprises a repeatable pattern including an octagonally shaped matrix array aperture 120 associated with a plurality of substantially hexagonally shaped alternate matrix array apertures 121. As illustrated, the octagonally shaped matrix array aperture 120 is positioned substantially central to four hexagonally shaped alternate matrix array apertures 121. Each of the hexagonally shaped alternate matrix array apertures 121 is offset an equal distance from the substantially centrally positioned octagonally shaped matrix array aperture 120.

In various exemplary, nonlimiting embodiments, a hexagonally shaped alternate matrix array aperture 121 is formed at 45°, 135°, 225°, and 315° from the substantially centrally positioned octagonally shaped matrix array aperture 120.

The octagonally and hexagonally shaped matrix array apertures 120 and alternate matrix array apertures 121 are merely exemplary and alternate shapes may be utilized to form the matrix array apertures 120 and alternate matrix array apertures 121.

FIG. 27 illustrates the exemplary embodiment of the repeatable modular attachment matrix array 100 pattern of FIG. 26 repeated, in a repeating fashion, as part of a matrix array layer 110, attached or coupled to a carrier material 12 according to an exemplary embodiment of the presently disclosed systems, methods, and/or apparatuses. As illustrated in FIG. 27, the repeatable pattern is repeated so that certain of the alternate matrix array apertures 121 overlap one another to form the matrix array pattern in the matrix array layer 110. It should be appreciated that the total number of matrix array apertures 120 and alternate matrix array apertures 121 used to form the modular attachment matrix array 100 of the matrix array layer 110 is a design choice, based upon the desired area that the modular attachment matrix array 100 is to cover, whether attached to a carrier material 12 or as a standalone matrix array layer 110.

In various exemplary, nonlimiting embodiments, the matrix array layer 110 is attached or coupled to a portion of the carrier material 12 by stitching proximate a perimeter of the matrix array layer 110. The matrix array layer 110 may then optionally be further attached or coupled to the carrier material 12, via additional matrix array layer attachment elements 130. The matrix array layer attachment elements 130 are spaced apart, as necessary or desirable, in order to further secure, attach, or couple the matrix array layer 110 to the carrier material 12. The number and placement of additional matrix array layer attachment elements 130 is a design choice based upon the desired level of securement of the matrix array layer 110 to the carrier material 12 and/or to further ensure that the matrix array layer 110 will not separate or pull away from the carrier material 12, particularly if accessories are attached or coupled to the matrix array layer 110.

In certain exemplary embodiments, the matrix array layer attachment elements 130 comprise stitching. Alternatively, the matrix array layer 110 may be attached or coupled to the carrier material 12 (either proximate a perimeter or at matrix array layer attachment elements 130) via stitching, adhesive bonding, welding, screws, rivets, pins, mating hook and loop portions, snap or releasable fasteners, or other known or later developed means or methods for permanently or releasably attaching or coupling the matrix array layer 110 to the carrier material 12.

In addition to the variability of size and shape of the matrix array layer 110, the orientation of the matrix array layer 110, relative to the carrier material 12, is also a design choice. Thus, it should be appreciated that the matrix array layer 110 may be attached at any desired angular or rotational orientation relative to a surface of the carrier material 12.

Portions of material of the matrix array layer 110 between matrix array apertures 120 and/or alternate matrix array apertures 121 form matrix array tunnel segments 135. If the matrix array layer 110 is attached to a carrier material 12, the matrix array tunnel segments 135 are formed between the matrix array layer 110 and the surface of the carrier material 12. The matrix array tunnel segments 135 provide areas for securing the accessory coupling element 88 of an accessory 81 to the matrix array layer 110. In this manner, an accessory coupling element 88 may be interwoven between the aligned matrix array tunnel segments 135 to removably attach the accessory 81 to the carrier material 12.

It should be appreciated that the length of each tunnel segment 135 is dictated by the size and shape of the matrix array layer 110 and the distance between matrix array apertures 120 and/or alternate matrix array apertures 121.

It should also be understood that tunnel segments 135 may be formed between matrix array apertures 120, between alternate matrix array apertures 121, or between matrix array apertures 120 and alternate matrix array apertures 121.

During attachment of an exemplary accessory 81, as described herein, the accessory 81 is aligned with the matrix array layer 110 in a desired orientation. As illustrated by the exemplary tunnel segments 135, the accessory 81 may optionally be aligned with the matrix array layer 110 in a generally vertical manner, in a generally horizontal manner, or in a generally oblique or diagonal manner. It should be understood that these orientations are relative to the orientation of the matrix array layer 110 and the orientation of the matrix array layer 110 relative to the carrier material 12.

Thus, an accessory 81 may be mounted to the matrix array layer 110 between matrix array apertures 120, alternate matrix array apertures 121, or matrix array apertures 120 and alternate matrix array apertures 121, in a variety of orientations.

It should be appreciated that a more detailed explanation of the instructions regarding how to interweave the accessory coupling element 88 between the matrix array apertures 120, alternate matrix array apertures 121, and accessory webbing elements 83 is not provided herein because it is believed that the level of description provided herein is sufficient to enable one of ordinary skill in the art to understand and practice the systems, methods, and apparatuses, as described.

FIG. 28 illustrates an exemplary embodiment of a repeatable modular attachment matrix array 100 pattern and FIG. 29 illustrates the exemplary embodiment of the repeatable modular attachment matrix array 100 pattern of FIG. 28 repeated as part of a matrix array layer 110, attached or coupled to a carrier material 12.

As illustrated in FIGS. 28 and 29, the exemplary modular attachment matrix array 100 comprises a repeatable pattern including one or more substantially square or rounded square shaped matrix array apertures 120 associated with a plurality of substantially elongate alternate matrix array apertures 121. As illustrated, a substantially square shaped matrix array aperture 120 is positioned substantially central to eight substantially elongate alternate matrix array apertures 121. Each of the substantially elongate alternate matrix array apertures 121 is offset an equal distance from the substantially centrally positioned substantially square shaped matrix array aperture 120.

In certain exemplary embodiments, additional substantially square shaped matrix array apertures 120 are formed equal distance from the substantially centrally positioned substantially square shaped matrix array aperture 120. In certain exemplary, nonlimiting embodiments, the additional substantially square shaped matrix array apertures 120 are formed at 0°, 90°, 180°, and 270° relative to the substantially centrally positioned substantially square shaped matrix array aperture 120.

As illustrated, the substantially elongate alternate matrix array apertures 121 are formed in parallel pairs and extend at 45°, 135°, 225°, and 315° from the substantially centrally positioned substantially square shaped matrix array aperture 120. It should be appreciated that the substantially elongate alternate matrix array apertures 121 may be formed as a single alternate aperture, in parallel pairs, or in a plurality of parallel substantially elongate alternate matrix array apertures 121.

The substantially square shaped matrix array apertures 120 and substantially elongate alternate matrix array apertures 121 are merely exemplary and alternate shapes may be utilized to form the substantially square shaped matrix array apertures 120 and substantially elongate alternate matrix array apertures 121.

FIG. 29 illustrates the exemplary embodiment of the repeatable modular attachment matrix array 100 pattern of FIG. 28 repeated, in a repeating fashion, as part of a matrix array layer 110, attached or coupled to a carrier material 12 according to an exemplary embodiment of the presently disclosed systems, methods, and/or apparatuses. As illustrated in FIG. 29, the repeatable pattern is repeated so that certain of the substantially elongate alternate matrix array apertures 121 overlap one another to form the matrix array pattern in the matrix array layer 110. It should be appreciated that the total number of substantially square shaped matrix array apertures 120 and substantially elongate alternate matrix array apertures 121 used to form the modular attachment matrix array 100 of the matrix array layer 110 is a design choice, based upon the desired area that the modular attachment matrix array 100 is to cover, whether attached to a carrier material 12 or as a standalone matrix array layer 110.

Figure 30:
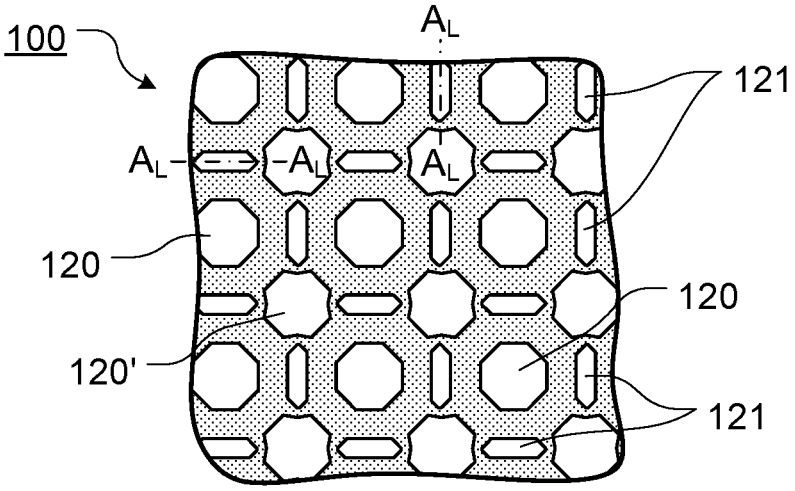
FIG. 30 illustrates an exemplary embodiment of the modular attachment matrix array attached or coupled to a carrier material, wherein the modular attachment matrix array comprises a plurality of substantially octagonally shaped matrix array apertures, a plurality of substantially "X" or "+" shaped matrix array apertures, and a plurality of alternate matrix array apertures, arranged according to an exemplary embodiment of the presently disclosed systems, methods, and/or apparatuses.
Figure 31:
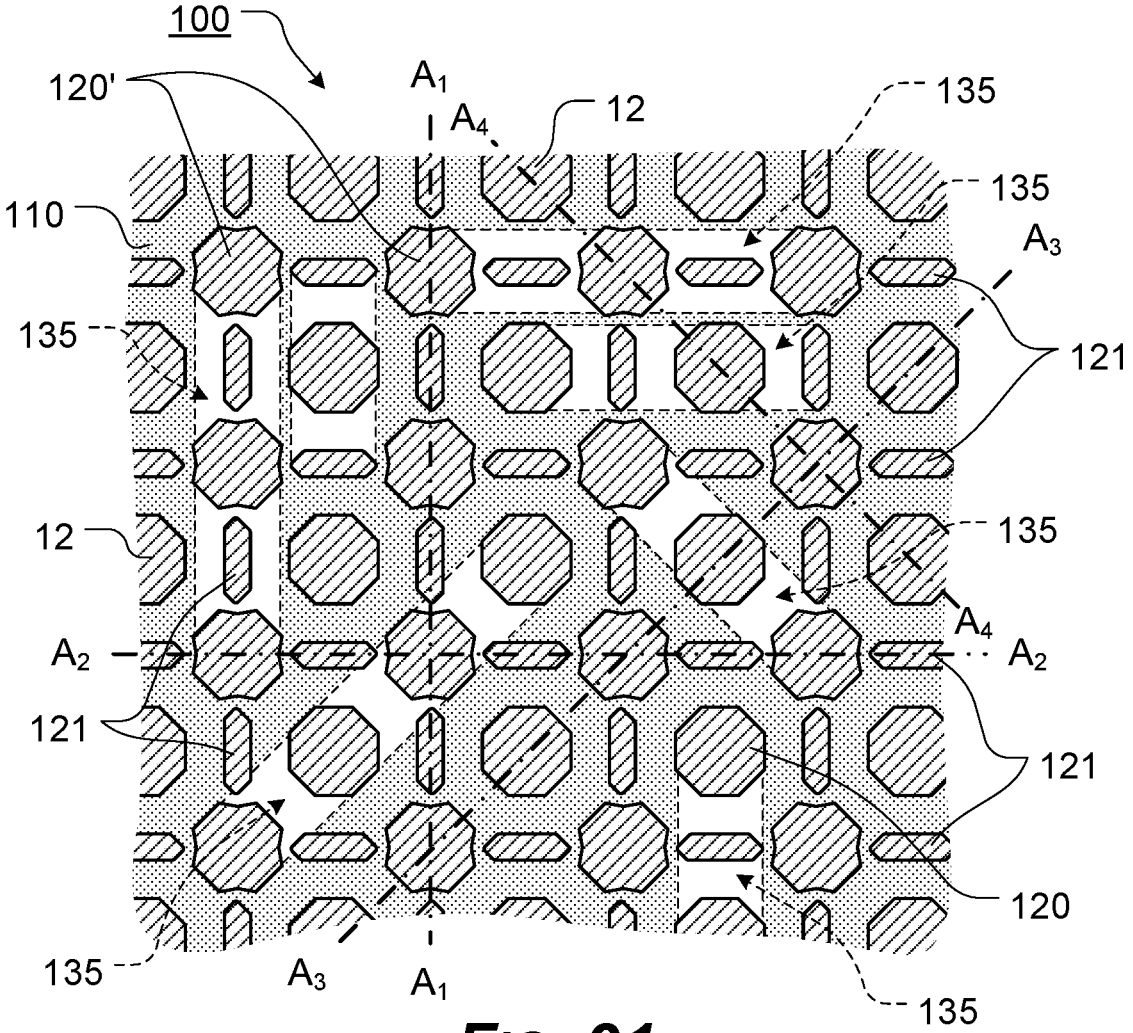
FIG. 31 illustrates an exemplary embodiment of the modular attachment matrix array attached or coupled to a carrier material, wherein the modular attachment matrix array comprises a plurality of substantially octagonally shaped matrix array apertures, a plurality of substantially "X" or "+" shaped matrix array apertures, and a plurality of alternate matrix array apertures, arranged according to an exemplary embodiment of the presently disclosed systems, methods, and/or apparatuses.
Figure 32:
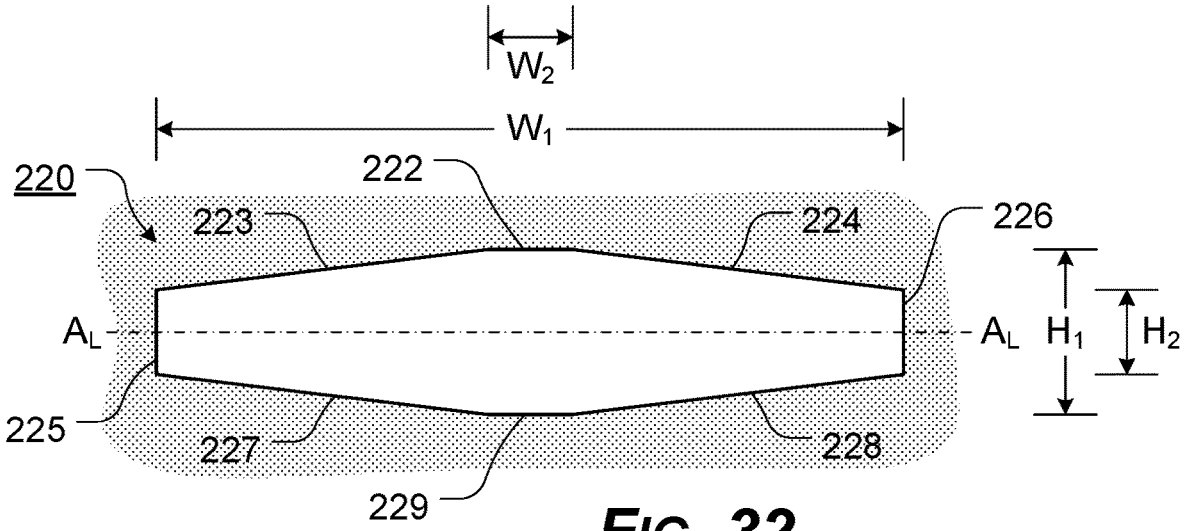
FIG. 32 illustrates an exemplary embodiment of a modular attachment matrix array aperture, according to an exemplary embodiment of the presently disclosed systems, methods, and/or apparatuses.

As illustrated in FIGS. 30 and 31, the exemplary modular attachment matrix array 100 comprises a repeatable pattern including a plurality of substantially octagonally shaped matrix array apertures 120, a plurality of substantially "X" or "+" shaped matrix array apertures 120', and a plurality of alternate matrix array apertures 121, arranged according to an exemplary embodiment of the presently disclosed systems, methods, and/or apparatuses. As further illustrated, the substantially octagonally shaped matrix array apertures 120 are arranged at spaced apart locations from one another substantially along or substantially in parallel to a first exemplary axis, $A_1$. In various exemplary embodiments, the substantially octagonally shaped matrix array apertures 120 are arranged at equally spaced apart locations substantially along or substantially in parallel to the first exemplary axis, $A_1$.

The substantially octagonally shaped matrix array apertures 120 are also arranged at spaced apart locations substantially along or substantially in parallel to a second exemplary axis, $A_2$. In various exemplary embodiments, the substantially octagonally shaped matrix array apertures 120 are arranged at equally spaced apart locations substantially along or substantially in parallel to the second exemplary axis, $A_2$.

Each of the plurality of alternate matrix array apertures 121 is formed by an elongate slot. An alternate matrix array aperture 121 is formed between each substantially octagonally shaped matrix array aperture 120. In various exemplary embodiments, as illustrated, the longitudinal axis, $A_L$, of each elongate slot is arranged so as to be substantially in parallel with the axis, $A_1$ or $A_2$, along which the substantially octagonally shaped matrix array apertures 120 are arranged.

In a similar fashion, the substantially "X" or "+" shaped matrix array apertures 120' are arranged at spaced apart locations from one another substantially along or substantially in parallel to a first exemplary axis, $A_1$. In various exemplary embodiments, the substantially "X" or "+" shaped matrix array apertures 120' are arranged at equally spaced apart locations substantially along or substantially in parallel to the first exemplary axis, $A_1$.

The substantially "X" or "+" shaped matrix array apertures 120' are also arranged at spaced apart locations substantially along or substantially in parallel to a second exemplary axis, $A_2$. In various exemplary embodiments, the substantially "X" or "+" shaped matrix array apertures 120' are arranged at equally spaced apart locations substantially along or substantially in parallel to the second exemplary axis, $A_2$.

Each of the plurality of alternate matrix array apertures 121 is formed by an elongate slot. An alternate matrix array aperture 121 is formed between each substantially "X" or "+" shaped matrix array aperture 120'. In various exemplary embodiments, as illustrated, the longitudinal axis, $A_L$, of each elongate slot is arranged so as to be substantially in parallel with the axis, $A_1$ or $A_2$, along which the substantially "X" or "+" shaped matrix array apertures 120' are arranged.

The substantially octagonally shaped matrix array apertures 120 and the substantially "X" or "+" shaped matrix array apertures 120' are arranged, in alternating fashion, at spaced apart locations substantially along or substantially in parallel to the third exemplary axis, $A_3$, or the fourth exemplary axis, $A_4$. In various exemplary embodiments, the substantially octagonally shaped matrix array apertures 120 and the substantially "X" or "+" shaped matrix array apertures 120' are arranged, in alternating fashion, at equally spaced apart locations substantially along or substantially in parallel to the third exemplary axis, $A_3$, or the fourth exemplary axis, $A_4$.

In various exemplary embodiments, the axis $A_1$ is arranged so as to be a substantially vertical axis, the axis, $A_2$, is arranged so as to be a substantially horizontal axis, and axis $A_3$ and $A_4$ are arranged so as to be substantially diagonal axis. However, it should be appreciated that these are merely exemplary embodiments and are not to be viewed as limiting the arrangement or orientation of the exemplary axes.

It should be appreciated that the substantially octagonally shaped matrix array apertures 120 and the substantially "X" or "+" shaped matrix array apertures 120' are merely exemplary and alternate shapes may be utilized in place of the substantially octagonally shaped matrix array apertures 120 and/or the substantially "X" or "+" shaped matrix array apertures 120'.

FIG. 31 illustrates the exemplary embodiment of the repeatable modular attachment matrix array 100 pattern of FIG. 30 repeated, in a repeating fashion, as part of a matrix array layer 110, attached or coupled to a carrier material 12 according to an exemplary embodiment of the presently disclosed systems, methods, and/or apparatuses.

It should be appreciated that the total number of substantially octagonally shaped matrix array apertures 120, substantially "X" or "+" shaped matrix array apertures 120', and alternate matrix array apertures 121 used to form the modular attachment matrix array 100 of the matrix array layer 110 is a design choice, based upon the desired area that the modular attachment matrix array 100 is to cover, whether attached to a carrier material 12 or as a standalone matrix array layer 110. Thus, a matrix array layer 110 of any desired size and/or shape may be created by including any number of desired substantially octagonally shaped matrix array apertures 120, substantially "X" or "+" shaped matrix array apertures 120', and alternate matrix array apertures 121.

FIG. 31 illustrates an exemplary embodiment of the modular attachment matrix array 100 attached or coupled to a carrier material 12, wherein the modular attachment matrix array 100 comprises a plurality of spaced apart, substantially octagonally shaped matrix array apertures 120, a plurality of "X" or "+" shaped matrix array apertures 120', and a plurality of substantially elongate alternate matrix array apertures 121 formed in a repeating pattern. By utilizing such a repeated series of alternating substantially octagonally shaped matrix array apertures 120, substantially "X" or "+" shaped matrix array apertures 120', and alternate matrix array apertures 121, tunnel segments 135, such as the exemplary tunnel segments 135 illustrated, may be joined and utilized between various horizontally, vertically, or diagonally positioned substantially octagonally shaped matrix array apertures 120, a plurality of "X or "+" shaped matrix array apertures 120', and a plurality of substantially elongate alternate matrix array apertures 121.

It should also be appreciated and understood that tunnel segments 135 may be created that begin or terminate with similar or differently shaped matrix array apertures 120. For example, an accessory 81 may be attached or coupled to the modular attachment matrix array 100 between similarly shaped matrix array apertures 120, between a substantially octagonally shaped matrix array aperture 120 and an "X or "+" shaped matrix array aperture 120', between a substantially octagonally shaped matrix array aperture 120 and a substantially elongate alternate matrix array aperture 121, or between a substantially "X or "+" shaped matrix array aperture 120' and a substantially elongate alternate matrix array aperture 121.

Tunnel segments 135 may also be created along a substantially horizontal axis, along a substantially vertical axis, or along a substantially diagonal axis.

In various exemplary, nonlimiting embodiments, the matrix array layer 110 is attached or coupled to a portion of the carrier material 12 by stitching proximate a perimeter of the matrix array layer 110. The matrix array layer 110 may then optionally be further attached or coupled to the carrier material 12, via additional matrix array layer attachment elements 130. The matrix array layer attachment elements 130 are spaced apart, as necessary or desirable, in order to further secure, attach, or couple the matrix array layer 110 to the carrier material 12. The number and placement of additional matrix array layer attachment elements 130 is a design choice based upon the desired level of securement of the matrix array layer 110 to the carrier material 12 and/or to further ensure that the matrix array layer 110 will not separate or pull away from the carrier material 12, particularly if accessories are attached or coupled to the matrix array layer 110.

In certain exemplary embodiments, the matrix array layer attachment elements 130 comprise stitching. Alternatively, the matrix array layer 110 may be attached or coupled to the carrier material 12 (either proximate a perimeter or at matrix array layer attachment elements 130) via stitching, adhesive bonding, welding, screws, rivets, pins, mating hook and loop portions, snap or releasable fasteners, or other known or later developed means or methods for permanently or releasably attaching or coupling the matrix array layer 110 to the carrier material 12.

In addition to the variability of size and shape of the matrix array layer 110, the orientation of the matrix array layer 110, relative to the carrier material 12, is also a design choice. Thus, it should be appreciated that the matrix array layer 110 may be attached at any desired angular or rotational orientation relative to a surface of the carrier material 12.

Portions of material of the matrix array layer 110 between substantially square shaped matrix array apertures 120 and/or substantially elongate alternate matrix array apertures 121 form matrix array tunnel segments 135. If the matrix array layer 110 is attached to a carrier material 12, the matrix array tunnel segments 135 are formed between the matrix array layer 110 and the surface of the carrier material 12. The matrix array tunnel segments 135 provide areas for securing the accessory coupling element 88 of an accessory 81 to the matrix array layer 110. In this manner, an accessory coupling element 88 may be interwoven between the aligned matrix array tunnel segments 135 to removably attach the accessory 81 to the carrier material 12.

It should be appreciated that the length of each tunnel segment 135 is dictated by the size and shape of the matrix array layer 110 and the distance between substantially square shaped matrix array apertures 120 and/or substantially elongate alternate matrix array apertures 121.

It should also be understood that tunnel segments 135 may be formed between substantially square shaped matrix array apertures 120, between substantially elongate alternate matrix array apertures 121, or between substantially square shaped matrix array apertures 120 and substantially elongate alternate matrix array apertures 121.

During attachment of an exemplary accessory 81, as described herein, the accessory 81 is aligned with the matrix array layer 110 in a desired orientation. As illustrated by the exemplary tunnel segments 135, the accessory 81 may optionally be aligned with the matrix array layer 110 in a generally vertical manner, in a generally horizontal manner, or in a generally oblique or diagonal manner. It should be understood that these orientations are relative to the orientation of the matrix array layer 110 and the orientation of the matrix array layer 110 relative to the carrier material 12.

Thus, an accessory 81 may be mounted to the matrix array layer 110 between substantially square shaped matrix array apertures 120, substantially elongate alternate matrix array apertures 121, or substantially square shaped matrix array apertures 120 and substantially elongate alternate matrix array apertures 121, in a variety of orientations.

It should be appreciated that a more detailed explanation of the instructions regarding how to interweave the accessory coupling element 88 between the substantially square shaped matrix array apertures 120, substantially elongate alternate matrix array apertures 121, and accessory webbing elements 83 is not provided herein because it is believed that the level of description provided herein is sufficient to enable one of ordinary skill in the art to understand and practice the systems, methods, and apparatuses, as described.

It should be appreciated that these are merely exemplary and not exhaustive examples of the sizes, shapes, and relative placements of exemplary matrix array apertures 120 and/or alternate matrix array apertures 121. Therefore, each of the matrix array apertures 120 and/or alternate matrix array apertures 121 may generally be formed in the shape of a triangle, a square, a rectangle, a pentagon, a hexagon (as illustrated in FIG. 13), a heptagon, an octagon, a nanogon, a decagon, a pentadecagon, an icosagon, a circle (as illustrated in FIG. 14), an oval, an "X", a "+", a slot, a dumbbell/barbell shape, or any other desired shape or configuration. Thus, it should be appreciated that the size and shape of each of the matrix array apertures 120 and/or alternate matrix array apertures 121 is a design choice based upon the desired functionality and/or appearance of the modular attachment matrix array 100 and/or the matrix array layer 110.

FIGS. 32-38 illustrate certain elements and/or aspects of an exemplary embodiment of the modular attachment matrix array 200, according to the presently disclosed systems, methods, and/or apparatuses.

In certain illustrative, non-limiting embodiment(s) of the presently disclosed systems, methods, and/or apparatuses, as illustrated in FIGS. 32-38, the modular attachment matrix array 200 comprises at least some of a matrix array layer 210 having a plurality of spaced apart matrix array apertures 220 formed therethrough, with tunnel segments 135 formed between certain of the spaced apart matrix array apertures 220, as described herein. The modular attachment matrix array 200 may optionally be at least partially attached or coupled to at least a portion of a carrier or carrier material, such as, for example, a carrier material 12.

It should be understood that each of these elements corresponds to and operates similarly to the modular attachment matrix array 100, matrix array layer 110, matrix array apertures 120, and tunnel segments 135, as described above with reference to the modular attachment matrix array 100 of FIGS. 3-12.

However, FIGS. 32-38 illustrate an exemplary embodiment of the modular attachment matrix array 200, wherein each matrix array aperture 220 is formed in the shape of an elongated octagon.

In certain exemplary embodiments, the matrix array layer 210 is formed of a portion of a fabric-type or other material, such as, for example, chlorosulfonated polyethylene (CSPE) synthetic rubber (CSM). In certain exemplary embodiments, the matrix array layer 210 is formed of a portion of Hypalon fabric. However, the present disclosure is not so limited. For example, in certain exemplary embodiments, the matrix array layer 210 may be formed of a rigid material, a semi-rigid material, or a substantially flexible material.

In various exemplary, non-limiting embodiments, all or portions of the matrix array layer 210 may be made of any fabric or other material, such as, for example, woven fabrics, canvas, acrylics, sheet fabrics, films, nylon, spandex, vinyl, Polyvinyl Chloride (PVC), neoprene, or the like. Alternatively, all or portions of the matrix array layer 210 may be formed from multiple, similar or dissimilar materials. In various exemplary, non-limiting embodiments, the matrix array layer 210 may be water-resistant or may include a cushion material.

As a further example, in certain exemplary embodiments, the matrix array layer 210 may be formed of a substantially rigid material, such as plastic, having an appropriate, workable thickness. Alternate materials of construction of the matrix array layer 210 may include one or more of the following: steel, stainless steel, aluminum, titanium, polytetrafluoroethylene, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the matrix array layer 210 is a design choice based on the desired appearance and functionality of the matrix array layer 210.

It should be appreciated that the terms fabric and material are to be given their broadest meanings and that the particular fabric(s) or material(s) used to form the matrix array layer 210 is a design choice based on the desired appearance and/or functionality of the modular attachment matrix array 200. In general, the material used to form the matrix array layer 210 is selected for its ability to allow a MOLLE-type accessory to be attached or coupled thereto.

The modular attachment matrix array 200 of the present disclosure is operable with as few as two matrix array apertures 220. Thus, the size and shape of the matrix array layer 210 is a design choice, based upon, for example, the size and shape of the carrier material 12 or portion of carrier material 12 that is desired to potentially accept attachment or coupling of accessories.

In various exemplary embodiments, the matrix array apertures 220 are generally formed as apertures through the matrix array layer 210. Each matrix array aperture 220 is defined by one or more continuous edges or edge portions. In various exemplary embodiments, each matrix array aperture 220 is formed in the shape of an elongated octagon. The edges or edge portions of each matrix array aperture 220 is/are defined by a first height, $H_1$, which extends so as to be defined between opposing edge portions 222 and 229. A second height, $H_2$, is defined by the lengths of opposing edge portions 225 and 226. The first height, $H_1$, is greater than the second height, $H_2$.

The edges or edge portions of each matrix array aperture 220 is/are further defined by a first width, $W_1$, which extends so as to be defined between opposing edge portions 225 and 226. A second width, $W_2$, is defined by the lengths of the opposing edge portions 222 and 229. The first width, $W_1$, is greater than the second width, $W_2$.

Opposing edge portions 222 and 229 are substantially parallel to one another, while opposing edge portions 225 and 226 are substantially parallel to one another. Edge portion 223 extends between edge portions 225 and 222, edge portion 224 extends between edge portions 226 and 222, edge portion 227 extends between edge portions 225 and 229, and edge portion 228 extends between edge portions 226 and 229. Thus, the matrix array aperture 220 takes the form of a substantially elongated octagon defined by edge portions 222, 223, 224, 225, 226, 227, 228, and 229.

Figure 34:
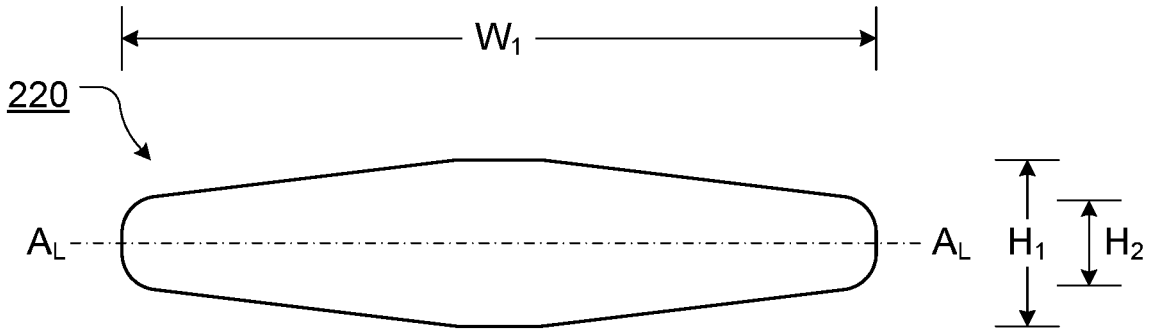
FIG. 34 illustrates an exemplary embodiment of a modular attachment matrix array aperture, according to an exemplary embodiment of the presently disclosed systems, methods, and/or apparatuses.
Figure 35:
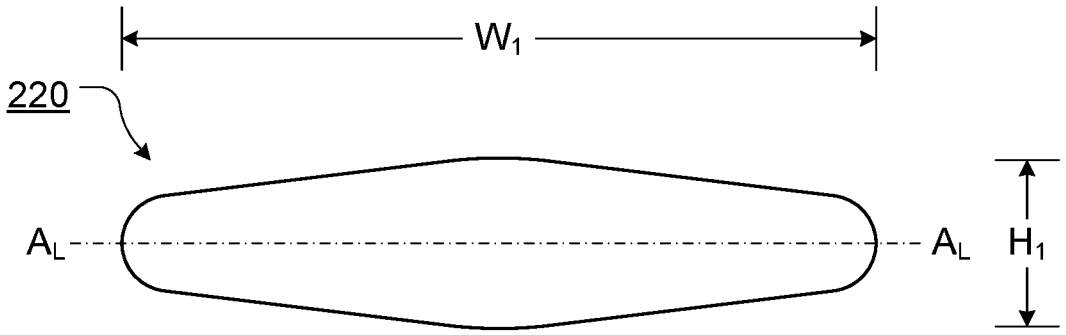
FIG. 35 illustrates an exemplary embodiment of a modular attachment matrix array aperture, according to an exemplary embodiment of the presently disclosed systems, methods, and/or apparatuses.
Figure 36:
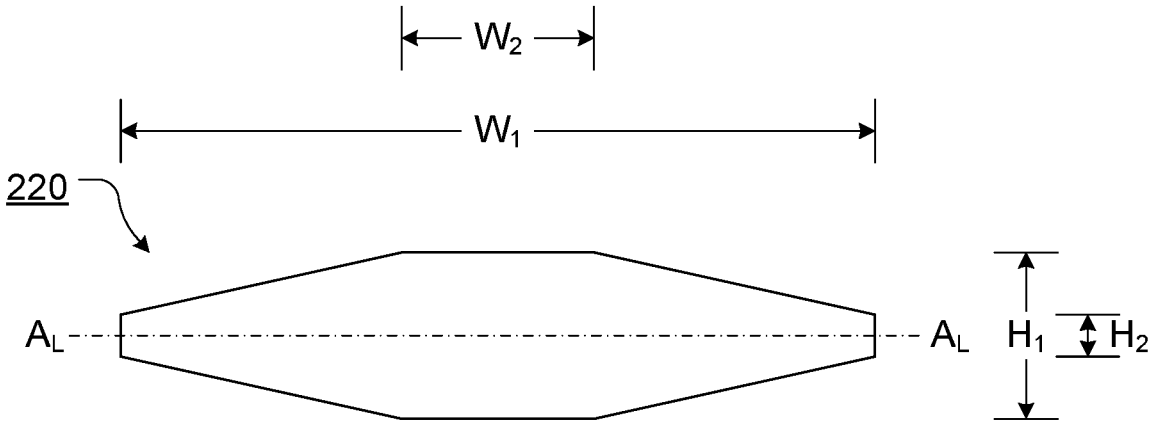
FIG. 36 illustrates an exemplary embodiment of a modular attachment matrix array aperture, according to an exemplary embodiment of the presently disclosed systems, methods, and/or apparatuses.

However, it should also be appreciated that each of the matrix array apertures 220 may generally be formed in the shape of an elongated octagon, wherein edge portions 222, 223, 224, 225, 226, 227, 228, and 229 join each other at rounded corners or edges (as illustrated in FIG. 34), an elongated octagon, wherein one or more edge portions 222, 223, 224, 225, 226, 227, 228, and 229 comprise a rounded or curved edge portions (as illustrated in FIG. 35), or an elongated octagon, wherein the lengths of the first height, $H_1$, the second height, $H_2$, the first width, $W_1$, and/or the second width, $W_2$, is varied (as illustrated in FIG. 36). Thus, it should be appreciated that the size and shape of each of the matrix array apertures 220 is a design choice based upon the desired functionality and/or appearance of the modular attachment matrix array 200 and/or the matrix array layer 210.

The overall size of each matrix array aperture 220 is also a design choice. In certain exemplary embodiments, the size of each matrix array aperture 220 is influenced or dictated by the width of the accessory coupling element of a compatible accessory, such as, for example, the accessory coupling element 88 of a compatible accessory 81. For example, if the accessory coupling element 88 has a width of approximately 1 inch, the first width, $W_1$, of each matrix array aperture 220 may optionally be approximately 1 inch, so as to allow the accessory coupling element 88 to be interwoven between two or more matrix array apertures 220 and fitted within a matrix array tunnel segment 235 are created between matrix array apertures 220. Alternatively, the size of each matrix array aperture 220 may be created such that only certain accessories are compatible with the matrix array layer 210 and the modular attachment matrix array 200.

The matrix array apertures 220 are arranged in a repeating, alternating, staggered, or semi-repeating series or sequence of spaced apart, repeating patterns. In various exemplary embodiments, the matrix array apertures 220 are arranged in a repeating, alternating, staggered, or semi-repeating series or sequence of spaced apart rows 213 and columns 212. In various exemplary embodiments, the matrix array apertures 220 are arranged in a series of equally spaced rows 213 and alternatingly offset, equally spaced columns 212.

Figure 33:
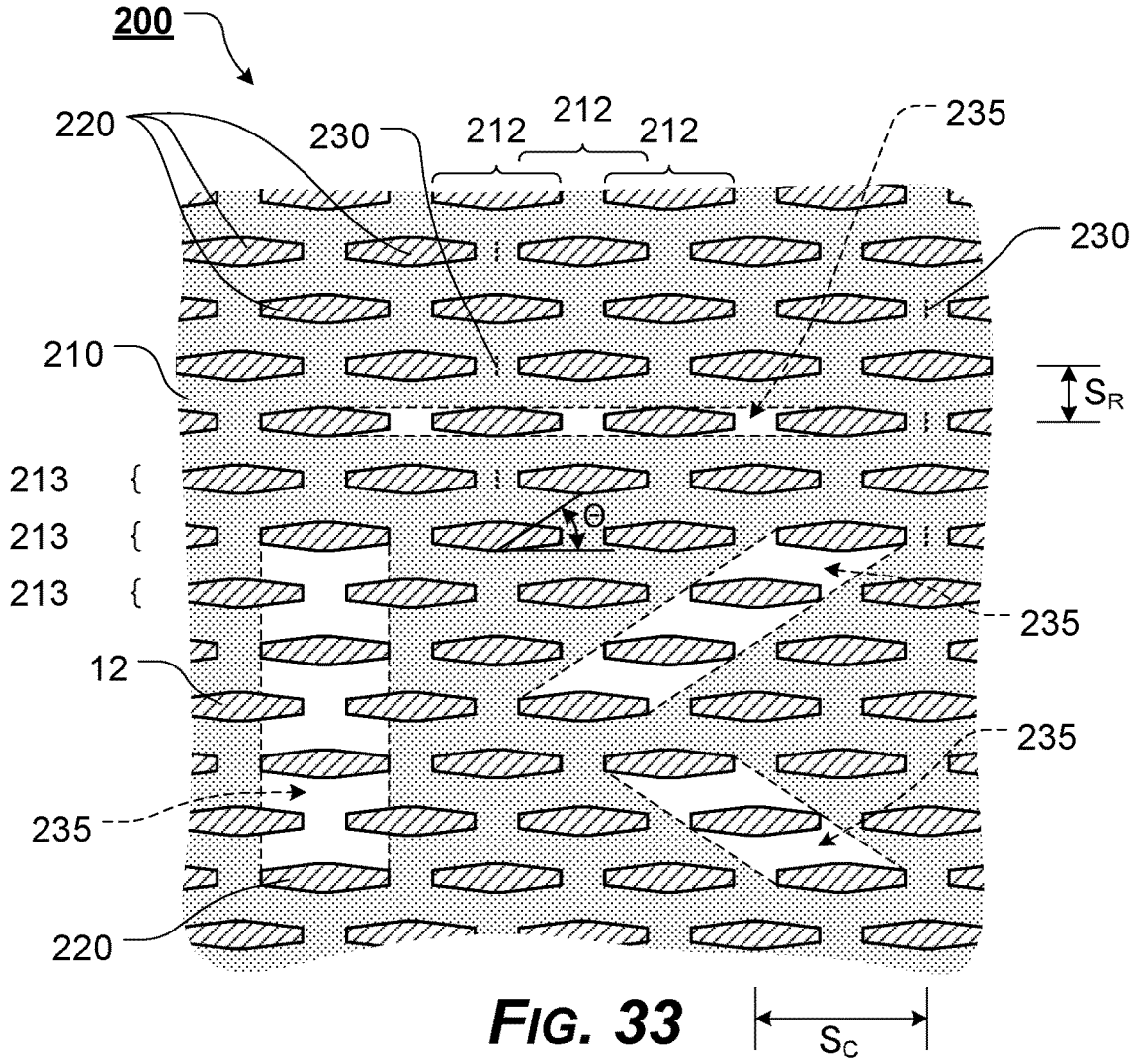
FIG. 33 illustrates an exemplary embodiment of a portion of a modular attachment matrix array, according to an exemplary embodiment of the presently disclosed systems, methods, and/or apparatuses.
Figure 37:
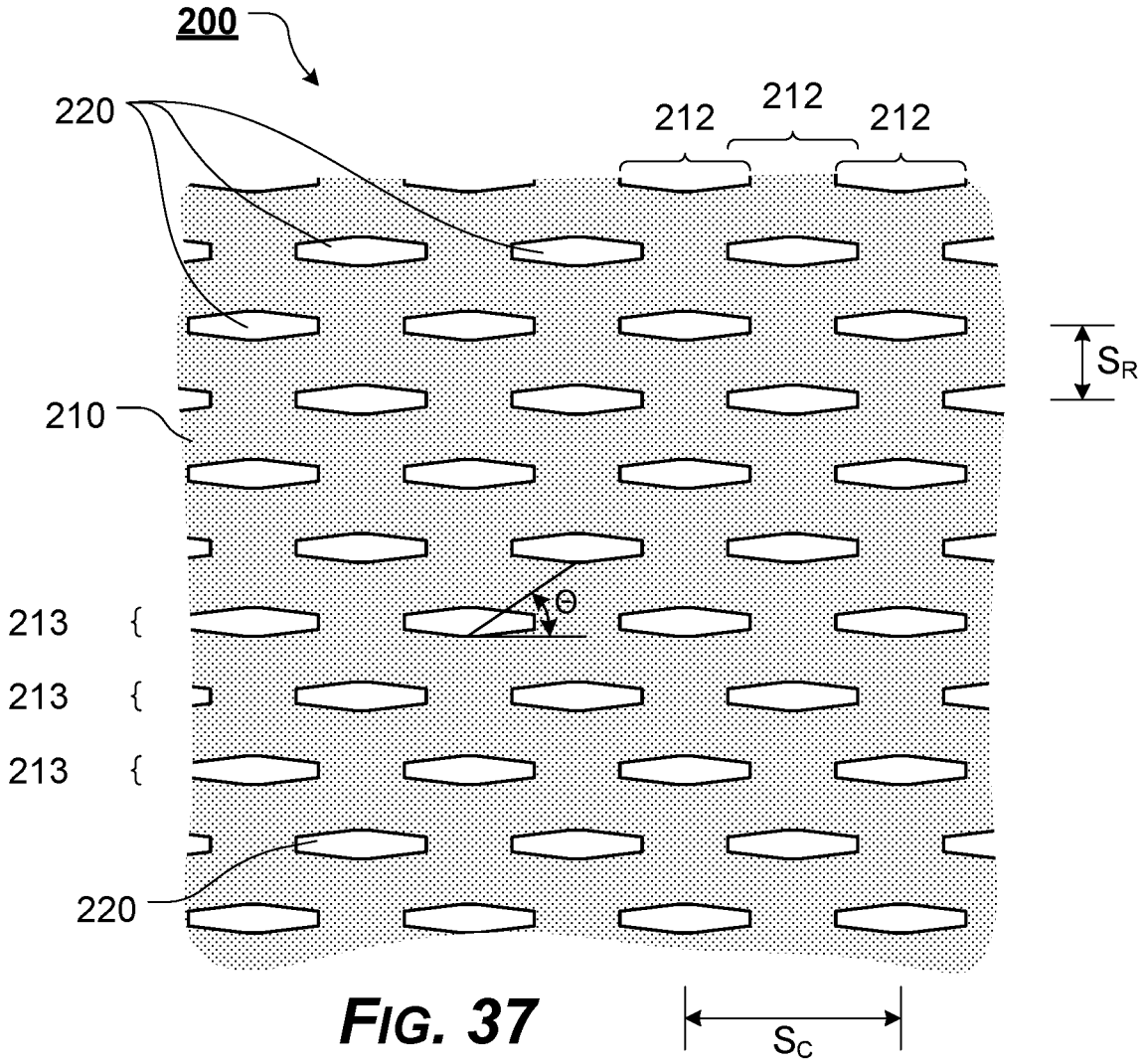
FIG. 37 illustrates an exemplary embodiment of a portion of a modular attachment matrix array, according to an exemplary embodiment of the presently disclosed systems, methods, and/or apparatuses.
Figure 38:
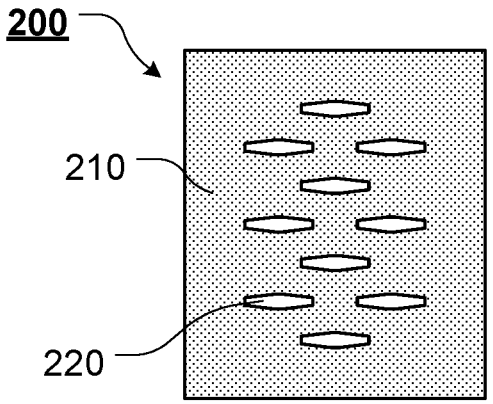
FIG. 38 illustrates an exemplary embodiment of a portion of a modular attachment matrix array, according to an exemplary embodiment of the presently disclosed systems, methods, and/or apparatuses.

In various exemplary embodiments, as illustrated in FIGS. 33, 37, and 38, the columns 212 are arranged such that each column 212 at least partially overlaps an adjacent column 212. It should be appreciated that the degree or amount of overlap of adjacent columns 212 is a design choice based upon the desired compatibility of certain accessories with the matrix array layer 210 and the modular attachment matrix array 200. By providing columns 212 that overlap one another, the number and spacing of positioning possibilities of attached accessories can be increased. Thus, the incremental shift of accessory attachment possibilities can be decreased. For example, instead of being restricted to attaching accessories at approximately 1½ inch increments (with known MOLLE webbing) overlapping columns 212 may, for example, allow attachment of accessories at approximately ½ inch, ¾ inch, or 1 inch increments. It should be appreciated that the incremental attachment options are a design choice based upon the desired degree of overlap, if any, of the columns 212.

In certain exemplary embodiments, the spacing between each of the rows 213 is less than or greater than the spacing between each of the columns 212.

In various exemplary embodiments, the spacing between either edge portions or proximate centers of adjacent matrix array apertures 220 (whether vertically, horizontally, obliquely, or diagonally adjacent) is influenced or dictated by the width of the accessory webbing element 83 of a compatible accessory 81. For example, if the accessory webbing element 83 has a width of approximately 1 inch, the spacing between either edges or proximate centers of adjacent matrix array apertures 220 may optionally be approximately 1 inch, so as to allow the accessory webbing element (s) 83 to be appropriately aligned between every or every other matrix array aperture 220 in a vertical, horizontal, oblique, or diagonal direction. Alternatively, the spacing between either edge portions or proximate centers of adjacent matrix array apertures 220 may be created such that only certain accessories are compatible with the matrix array layer 210 and the modular attachment matrix array 200.

It should be appreciated that two or more adjacent matrix array apertures 220 may comprise a row 213 and two or more adjacent matrix array apertures 220 may comprise a column 212, as illustrated, for example, in FIG. 38. Thus, it should be appreciated that the number of matrix array apertures 220 formed in the matrix array layer 210 is a design choice based upon the desired size and/or functionality of the matrix array layer 210.

In various exemplary, nonlimiting embodiments, each adjacent row 213 and/or column 212 of spaced apart matrix array apertures 220 is offset such that either edges or proximate centers of adjacent matrix array apertures 220 are offset by an angle, θ, of approximately ±33° (as illustrated in FIG. 33). FIG. 37 illustrates an alternative spacing of the rows 213 and columns 212 forming the matrix array layer 210.

It should be appreciated that the spacing between adjacent matrix array apertures 220 and/or the offset of adjacent rows 213 and/or columns 212 dictates the angle of attachment of accessories to the matrix array layer 210.

In certain exemplary, nonlimiting embodiments, each matrix array aperture 220 is separated from each other matrix array aperture 220 by a distance that is less than the first width, $W_1$, of each matrix array aperture 220.

By arranging the matrix array apertures 220 in a repeating, alternating, staggered, or semi-repeating series or sequence, matrix array tunnel segments 235 are created between adjacent matrix array apertures 220 (whether vertically, horizontally, obliquely, or diagonally adjacent).

In various exemplary embodiments, the matrix array layer 210 is formed as a stand-alone element, such as, for example, a sheet of matrix array layer 210 material, to which compatible accessories may be attached or coupled. Alternatively, the matrix array layer 210 may optionally be utilized as a portion of material used to form an accessory, such as, for example, a pouch or carrier. For example, a portion of matrix array layer 210 may be utilized as a wall segment of a magazine or other pouch. In still other alternative embodiments, several matrix array apertures 220 may be formed in a portion of material, such that the portion of material constitutes a portion of matrix array layer 210.

In still other exemplary, nonlimiting embodiments, the matrix array layer 210 may optionally be at least partially attached or coupled to at least a portion of a carrier or carrier material, such as, for example, a carrier material 12. Thus, the matrix array layer 210 may be at least partially attached or coupled to an exemplary carrier (such as, for example, exemplary carrier material 12), for example, an article of clothing, a vest, a plate carrier, a backpack, a pack, a bag, a platform, or another flexible, semi-rigid, or rigid carrier.

As illustrated, for example, in FIG. 33, the matrix array layer 210 is attached or coupled to a portion of carrier material 12, via stitching or other matrix array layer attachment elements 230. The matrix array layer attachment elements 230 may optionally be spaced apart, as necessary or desirable, in order to further secure, attach, or couple the matrix array layer 210 to the carrier material 12. The number and placement of matrix array layer attachment elements 230 is a design choice based upon the desired level of securement of the matrix array layer 210 to the carrier material 12 and/or to further ensure that the matrix array layer 210 will not separate or pull away from the carrier material 12, particularly if accessories are attached or coupled to the matrix array layer 210.

In certain exemplary embodiments, the matrix array layer attachment elements 230 comprise stitching. Alternatively, the matrix array layer 210 may be attached or coupled to the carrier material 12 at one or more matrix array layer attachment elements 230 via adhesive bonding, welding, screws, rivets, pins, mating hook and loop portions, snap or releasable fasteners, or other known or later developed means or methods for permanently or releasably attaching or coupling the matrix array layer 210 to the carrier material 12. The one or more matrix array layer attachment elements 230 may be formed or positioned proximate a perimeter of the matrix array layer 210 or in one or more areas located within the one or more matrix array layers 210.

In addition to the variability of size and shape of the matrix array layer 210, the orientation of the matrix array layer 210, relative to the carrier material 12, is also a design choice. Thus, the matrix array apertures 220 are illustrated as being arranged or oriented in a particular manner, relative to the matrix array layer 210, such that the rows 213 of matrix array apertures 220 are arranged in an exemplary, horizontal fashion, while the columns 212 of matrix array apertures 220 are arranged in an exemplary, vertical fashion. It should be appreciated that this is merely exemplary and the matrix array layer 210 may be formed, attach, or coupled at any desired angular or rotational orientation relative to a surface of the carrier material 12.

The portions of material of the matrix array layer 210 between adjacent matrix array apertures 220 form matrix array tunnel segments 235. If the matrix array layer 210 is attached to a carrier material 12, the matrix array tunnel segments 235 are formed between the matrix array layer 210 and the surface of the carrier material 12. The matrix array tunnel segments 235 provide areas for securing the accessory coupling element 88 of an accessory 81 to the matrix array layer 210. In this manner, an accessory coupling element 88 may be interwoven between the aligned matrix array tunnel segments 235 to removably attach the accessory 81 to the carrier material 12.

During attachment of an exemplary accessory 81, the accessory 81 is aligned with the matrix array layer 210 in a desired orientation, similar to the fashion illustrated in FIGS. 5-12. The accessory 81 may optionally be aligned with the matrix array layer 210 in a generally vertical or horizontal manner or a generally oblique or diagonal manner. It should be understood that these orientations are relative to the orientation of the matrix array layer 210 and the orientation of the matrix array layer 210 relative to any optional carrier material 12.

The exemplary accessory 81 includes one or more substantially parallel, spaced apart accessory webbing elements 83. If more than one accessory webbing element 83 is included, the accessory webbing elements 83 are spaced apart so as to correspond to the spaces between the spaced apart matrix array apertures 220.

When the accessory 81 is placed adjacent the matrix array layer 210 such that at least a portion of the accessory webbing elements 83 are within a portion of the spaces between the spaced apart matrix array apertures 220 (and at least a portion of the matrix array apertures 220 are within the spaces between the spaced apart accessory webbing elements 83) and corresponding matrix array tunnel segments 235 and accessory tunnel segments 87 are aligned, the accessory coupling element 88 may be interwoven between the aligned matrix array tunnel segments 235 and accessory tunnel segments 87 (alternating between adjacent matrix array apertures 220 and/or alternate attachment apertures 221 of the matrix array layer 210 and accessory webbing elements 83 on the accessory 81) to removably attach the accessory 81 to the matrix array layer 210.

Thus, an accessory 81 may be mounted to the matrix array layer 210 in a variety of orientations. Likewise, if a particular carrier material 12 includes a matrix array layer 210, a variety of accessories may be interchangeably mounted to the matrix array layer 210 to accommodate a variety of desired configurations.

It should be appreciated that a more detailed explanation of the instructions regarding how to interweave the accessory coupling element 88 between the matrix array apertures 220 and accessory webbing elements 83 is not provided herein because, while the matrix array layer 210 provides more orientation options and other features, accessories are generally attached to the matrix array layer 210 in a manner similar to the manner in which accessories are attached to a portion of MOLLE webbing. Therefore, it is believed that the level of description provided herein is sufficient to enable one of ordinary skill in the art to understand and practice the systems, methods, and apparatuses, as described.

While the presently disclosed systems, methods, and/or apparatuses has been described in conjunction with the exemplary embodiments outlined above, the foregoing description of exemplary embodiments of the presently disclosed systems, methods, and/or apparatuses, as set forth above, are intended to be illustrative, not limiting and the fundamental disclosed systems, methods, and/or apparatuses should not be considered to be necessarily so constrained. It is evident that the presently disclosed systems, methods, and/or apparatuses is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the presently disclosed systems, methods, and/or apparatuses. The upper and lower limits of these smaller ranges may independently be included in the smaller ranges and is also encompassed within the presently disclosed systems, methods, and/or apparatuses, subject to any specifically excluded limit in the stated range. Where the stated range includes one or both of the limits, ranges excluding either or both of those included limits are also included in the presently disclosed systems, methods, and/or apparatuses.

It is to be understood that the phraseology of terminology employed herein is for the purpose of description and not of limitation. Unless defined otherwise, all technical and scientific terms used herein have the same meaning as commonly understood by one of ordinary skill in the art to which the presently disclosed systems, methods, and/or apparatuses belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the presently disclosed systems, methods, and/or apparatuses, such that others may, by applying current knowledge, change, vary, modify, and/or adapt these exemplary, non-limiting embodiments for various applications without departing from the spirit and scope of the presently disclosed systems, methods, and/or apparatuses and elements or methods similar or equivalent to those described herein can be used in practicing the presently disclosed systems, methods, and/or apparatuses. Any and all such changes, variations, modifications, and/or adaptations should and are intended to be comprehended within the meaning and range of equivalents of the disclosed exemplary embodiments and may be substituted without departing from the true spirit and scope of the presently disclosed systems, methods, and/or apparatuses.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A modular attachment matrix array, comprising:

a portion of carrier material; and a matrix array layer, wherein said matrix array layer comprises a plurality of spaced apart matrix array apertures, wherein each of said matrix array apertures is formed through said matrix array layer, wherein each of said matrix array apertures is defined by at least two opposing edge portions formed substantially parallel to one another and at least two opposing, rounded or curved edge portions, wherein each of said at least two rounded or curved edge portions joins each of said at least two substantially parallel opposing edge portions, and wherein said matrix array apertures are arranged in a repeating sequence of equally spaced rows and equally spaced columns, and wherein said matrix array layer is at least partially attached or coupled to at least a portion of said carrier material.

2. The modular attachment matrix array of claim 1, wherein said plurality of spaced apart matrix array apertures are arranged in a repeating sequence of equally spaced rows of said matrix array apertures and equally spaced columns of said matrix array apertures.

3. The modular attachment matrix array of claim 1, wherein matrix array tunnel segments are created between adjacent matrix array apertures.

4. The modular attachment matrix array of claim 1, wherein matrix array tunnel segments are created between vertically adjacent matrix array apertures, between horizontally adjacent matrix array apertures, between obliquely adjacent matrix array apertures, and/or between diagonally adjacent matrix array apertures.

5. The modular attachment matrix array of claim 1, wherein each of said matrix array apertures is defined by one or more continuous edges.

6. The modular attachment matrix array of claim 1, wherein each adjacent column of spaced apart matrix array apertures is offset such that at least edges or proximate centers of adjacent matrix array apertures are offset by approximately ±33°.

7. The modular attachment matrix array of claim 1, wherein each column of spaced apart matrix array apertures is staggered from an adjacent column of spaced apart matrix array apertures such that each column of spaced apart matrix array apertures at least partially overlaps an adjacent column of spaced apart matrix array apertures.

8. The modular attachment matrix array of claim 1, wherein each matrix array aperture is separated from each other matrix array aperture by a distance that is less than a width of each matrix array aperture.

9. The modular attachment matrix array of claim 1, wherein said matrix array layer comprises chlorosulfonated polyethylene (CSPE) synthetic rubber (CSM), a woven fabrics, canvas, acrylic, sheet fabric, film, nylon, spandex, vinyl, Polyvinyl Chloride (PVC), and/or neoprene.

10. The modular attachment matrix array of claim 1, wherein said matrix array layer comprises a portion of Hypalon fabric.

11. A modular attachment matrix array, comprising:

a matrix array layer, wherein said matrix array layer comprises a plurality of spaced apart matrix array apertures, wherein each of said matrix array apertures is formed through said matrix array layer, wherein each of said matrix array apertures is defined by at least two opposing edge portions formed substantially parallel to one another and at least two opposing, rounded or curved edge portions, wherein each of said at least two rounded or curved edge portions joins each of said at least two substantially parallel opposing edge portions, and wherein said matrix array apertures are arranged in a repeating or semi-repeating series or sequence of equally spaced rows and equally spaced columns.

12. The modular attachment matrix array of claim 11, wherein said matrix array layer is at least partially attached or coupled to at least a portion of a carrier material.

13. The modular attachment matrix array of claim 11, wherein each adjacent column of spaced apart matrix array apertures is offset such that at least edges or proximate centers of adjacent matrix array apertures are offset by approximately ±33°.

14. The modular attachment matrix array of claim 11, wherein each column of spaced apart matrix array apertures at least partially overlaps an adjacent column of spaced apart matrix array apertures.

15. The modular attachment matrix array of claim 11, wherein said plurality of spaced apart matrix array apertures are arranged in a repeating sequence of equally spaced rows of said matrix array apertures and equally spaced columns of said matrix array apertures.

16. A modular attachment matrix array, comprising:

a matrix array layer, wherein said matrix array layer comprises a plurality of spaced apart matrix array apertures, wherein each of said matrix array apertures is defined by at least two opposing edge portions formed substantially parallel to one another and at least two opposing, rounded or curved edge portions, wherein each of said at least two rounded or curved edge portions joins each of said at least two substantially parallel opposing edge portions, and wherein said matrix array apertures are arranged in a repeating sequence of equally spaced rows of said matrix array apertures and equally spaced columns of said matrix array apertures.

17. The modular attachment matrix array of claim 16, wherein each adjacent column of spaced apart matrix array apertures is offset such that at least edges or proximate centers of adjacent matrix array apertures are offset by approximately ±33°.

18. The modular attachment matrix array of claim 16, wherein each column of spaced apart matrix array apertures at least partially overlaps an adjacent column of spaced apart matrix array apertures.

19. The modular attachment matrix array of claim 16, wherein said plurality of spaced apart matrix array apertures are arranged in a repeating sequence of equally spaced rows of said matrix array apertures and equally spaced columns of said matrix array apertures.

20. The modular attachment matrix array of claim 16, wherein said matrix array layer is at least partially attached or coupled to at least a portion of a carrier material.

* * * * *